US007946125B2

(12) United States Patent
Visin et al.

(10) Patent No.: US 7,946,125 B2
(45) Date of Patent: May 24, 2011

(54) WATER SPILLAGE MANAGEMENT FOR IN THE DOOR ICE MAKER

(75) Inventors: Jerry M. Visin, Benton Harbor, MI (US); Guolian Wu, Saint Joseph, MI (US); Marcus R. Fischer, Saint Joseph, MI (US); Michele E. Wilcox, Stevensville, MI (US); Martin D. Lewis, Paw Paw, MI (US); Kevin M. Chase, Granger, IN (US)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 12/607,342

(22) Filed: Oct. 28, 2009

(65) Prior Publication Data

US 2010/0043457 A1 Feb. 25, 2010

Related U.S. Application Data

(60) Continuation of application No. 12/055,699, filed on Mar. 26, 2008, now Pat. No. 7,628,031, which is a division of application No. 10/973,559, filed on Oct. 26, 2004, now Pat. No. 7,437,885.

(51) Int. Cl.

| | |
|---|---|
| ***F25C 5/18*** | (2006.01) |
| ***F25D 19/02*** | (2006.01) |
| ***F25D 19/00*** | (2006.01) |
| ***F25D 3/02*** | (2006.01) |

(52) U.S. Cl. ..... 62/344; 62/448; 62/449; 62/459

(58) Field of Classification Search ..... 62/71, 441, 62/344, 420, 448, 449, 459; 312/305

See application file for complete search history.

(56) References Cited

U.S. PATENT DOCUMENTS

| | | | |
|---|---|---|---|
| 2,503,693 | A | 4/1950 | Van Lennep |
| 2,900,803 | A | 8/1959 | Horton, Jr. |
| 3,146,601 | A | 9/1964 | Gould |
| 3,299,656 | A | 1/1967 | Linstromberg et al. |
| 3,359,747 | A | 12/1967 | Linstromberg et al. |
| 3,362,181 | A | 1/1968 | Linstromberg |
| 3,382,682 | A | 5/1968 | Frohbieter |
| 3,383,876 | A | 5/1968 | Frohbieter |
| 3,648,476 | A | 3/1972 | Linstromberg |
| 3,677,030 | A | 7/1972 | Nicholas |
| 3,727,428 | A | 4/1973 | Linstromberg |
| 3,763,662 | A | 10/1973 | Nichols |
| 3,776,504 | A | 12/1973 | Wiley |
| 3,779,032 | A | 12/1973 | Nichols |
| 3,871,242 | A | 3/1975 | Linstromberg et al. |
| 3,962,886 | A | 6/1976 | Hammar |

(Continued)

FOREIGN PATENT DOCUMENTS

| | | | |
|---|---|---|---|
| EP | 1482261 | A2 | 12/2004 |

(Continued)

*Primary Examiner* — Chen-Wen Jiang

(74) *Attorney, Agent, or Firm* — John W. Morrison; Robert L. Judd

(57) ABSTRACT

A refrigerator freezer having an ice maker positioned on a refrigerator compartment or freezer compartment door. The ice maker is arranged to prevent or manage spills from the ice maker in the event the door on which the ice maker is mounted is opened or closed when unfrozen water is present in the ice maker. Spill management embodiments for a number of fixed and movable tray ice makers are disclosed.

12 Claims, 16 Drawing Sheets

U.S. PATENT DOCUMENTS

| | | | |
|---|---|---|---|
| 3,964,269 | A | 6/1976 | Linstromberg |
| 4,233,819 | A | 11/1980 | Stottmann |
| 4,306,423 | A | 12/1981 | Webb et al. |
| 4,432,529 | A | 2/1984 | McMillan |
| 4,649,717 | A | 3/1987 | Tate, Jr. et al. |
| 4,649,718 | A | 3/1987 | Linstromberg et al. |
| 4,967,995 | A | 11/1990 | Burgess |
| 5,188,744 | A | 2/1993 | Silverman |
| 5,196,127 | A | 3/1993 | Solell |
| 5,400,605 | A | 3/1995 | Jeong |
| 5,425,248 | A | 6/1995 | Trantina |
| 6,082,130 | A | 7/2000 | Pastryk et al. |
| 6,148,624 | A | 11/2000 | Bishop et al. |
| 7,017,364 | B2 | 3/2006 | Lee et al. |
| 7,263,854 | B2 | 9/2007 | Lee et al. |
| 2004/0237563 | A1 | 12/2004 | Lee et al. |
| 2006/0117786 | A1 | 6/2006 | Lee et al. |

FOREIGN PATENT DOCUMENTS

| | | | |
|---|---|---|---|
| EP | 1482263 | A2 * | 12/2004 |

* cited by examiner

WATER SPILLAGE MANAGEMENT FOR IN THE DOOR ICE MAKER

CROSS REFERENCE TO RELATED APPLICATIONS

The present application constitutes a continuation of U.S. patent application Ser. No. 12/055,699, entitled "WATER SPILLAGE MANAGEMENT FOR IN THE DOOR ICE MAKER" filed Mar. 26, 2008 now U.S. Pat. No. 7,628,031, issued Dec. 8, 2009, which is a divisional application of U.S. patent application Ser. No. 10/973,559, entitled "WATER SPILLAGE MANAGEMENT FOR IN THE DOOR ICE MAKER" filed Oct. 26, 2004, now U.S. Pat. No. 7,437,885, issued Oct. 21, 2008 which applications are hereby incorporated by reference. The present application is also related to continuation U.S. patent application Ser. Nos. 12/607,287, 12/607,302, 12/607,325, 12/607,359, 12/607,377 and 12/607,503 each entitled "WATER SPILLAGE MANAGEMENT FOR IN THE DOOR ICE MAKER" filed concurrently with the present application, each of which constitutes a continuation of U.S. patent application Ser. No. 12/055,699 entitled "WATER SPILLAGE MANAGEMENT FOR IN THE DOOR ICE MAKER" filed Mar. 26, 2008, now U.S. Pat. No. 7,628,031, which is a divisional application of U.S. patent application Ser. No. 10/973,599, entitled "WATER SPILLAGE MANAGEMENT FOR IN THE DOOR ICE MAKER", filed Oct. 26, 2004, now U.S. Pat. No. 7,437,885. The present application is also related to continuation in part U.S. patent application Ser. No. 11/436,079, entitled "WATER SPILLAGE MANAGEMENT FOR IN THE DOOR ICE MAKER", filed May 17, 2006, now U.S. Pat. No. 7,628,030, issued Dec. 8, 2009.

BACKGROUND OF THE INVENTION

1. Field of the Invention

This invention relates to ice makers positioned on a refrigerator or freezer compartment door. According to the invention the ice makers can be arranged to prevent or manage spills of water from the ice maker in the event the door on which the ice maker is mounted is opened and closed when unfrozen water is present in the ice maker.

2. Description of the Related Art

Manually filled ice cube trays having a cover or lid to prevent spills of water are known. Ice makers located on a refrigerator or freezer compartment door that do not include spill management features are known in the art.

Side by side refrigerator freezers having ice cube storage and dispenser mechanisms on the freezer door to supply an ice and water dispenser on the face of the freezer compartment door are well known in the art.

A variety of fixed ice mold and flexible tray automatic ice makers are known in the art.

SUMMARY OF THE INVENTION

The invention relates to a refrigerator freezer comprising having a freezer compartment maintained at a temperature below 0° C., an insulated freezer compartment door, a refrigerator compartment maintained at a temperature above 0° C., an insulated refrigerator compartment door, a refrigeration system for cooling the freezer compartment and the refrigerator compartment and an automatic ice maker positioned on one of the refrigerator compartment door and the freezer compartment door. The ice maker includes an ice mold and a flexible ice piece stripper positioned above a first portion of the ice mold having a plurality of slits forming a plurality of fingers. The ice maker further includes an ice rake having a plurality of tines rotatably mounted above the ice mold and arranged for the tines to rotate through the plurality of slits and through the ice mold to carry ice pieces out of the ice mold. The ice maker further includes a hood extending above a second portion of the ice mold.

The flexible ice piece stripper can extend from the ice rake to a first edge of the ice mold and can be arranged to substantially cover the first portion of the ice mold from the centerline of the ice mold to the first edge of the ice mold. The hood can extend from a second edge of the ice mold substantially to the center line of the ice mold above the ice mold to allow the ice rake to rotate through the ice mold.

DETAILED DESCRIPTION OF THE INVENTION

Figure 1A:
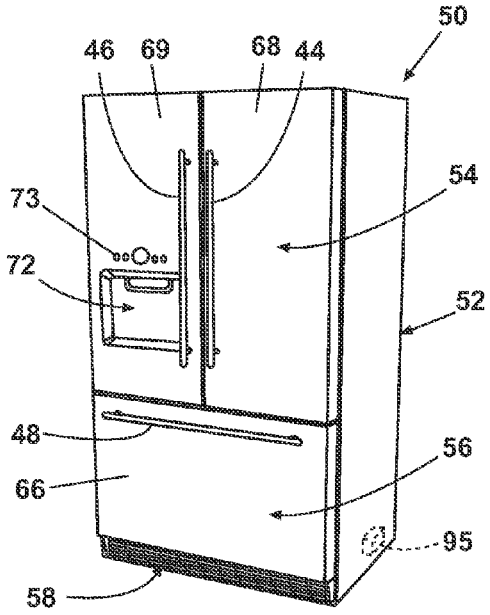
FIG. 1A is a perspective view of bottom freezer refrigerator comprising one embodiment of an in the door ice maker according to the invention.

One of the most desired accessories for a household refrigerator is a through-the-door ice and water system. A through-the-door ice and water dispenser is desirable because it greatly simplifies the process of retrieving ice cubes, i.e. it eliminates opening the door, removing the ice cube storage bin, separating and scooping ice cubes, and pouring the ice cubes into a glass. The feature also can be viewed as an energy saver, since the freezer door is not opened as often.

In today's household refrigerator market, there are three basic configurations to choose from: a bottom freezer refrigerator in which the refrigerator compartment is located above the freezer compartment, a top-mount refrigerator in which the freezer compartment is located above the refrigerator compartment, and a side by side refrigerator in which the refrigerator compartment and the freezer compartment extend the entire height of the refrigerator.

In the side by side configuration the ice cube storage bin and dispenser can be positioned on the freezer compartment door. It would be advantageous to also position the ice maker on the freezer door to provide additional shelf storage space in the freezer compartment. Likewise, it would be desirable to provide ice and water dispensers for bottom freezer refrigerators. However, to do so essentially requires providing ice making and storage mechanisms in the refrigerator compartment or on a refrigerator compartment door.

With current ice making and dispensing technology, it has not been possible for a consumer to have an ice and water dispenser features on a bottom freezer refrigerator compartment door, or a side by side refrigerator freezer door with the ice and water dispenser mechanisms totally positioned on a door. One of the biggest challenges is how to manage water spillage that may occur when the door on which an ice cube maker is positioned is abruptly opened or closed when water is present in the ice mold. According to applicants' invention spillage of water from an ice maker positioned on a refrigerator or freezer compartment door is prevented or managed.

It should be noted that the embodiments described in this application share many of the same elements, such as a dispensing outlet mounted on the outside of a refrigerator or freezer compartment door, an ice cube storage bin and an ice dispenser. Similarly ice makers that are the subject of applicants' invention share many of the same elements. It will be understood that the operation of these elements will generally be the same for each embodiment, and a description of their operation will not be repeated for each embodiment, unless otherwise noted. As well, elements common to more than one embodiment will usually be identified with common numerals. For example, each of the ice maker embodiments can include an ice maker control, identified as ice maker control 33, and motor 35 in the embodiment of FIG. 2. Ice cubes 34 are illustrated and described as generally semicircular pieces of ice, although the inventive concepts described herein are not so limited, and are equally applicable to ice pieces having a cylindrical, rectilinear or other shape. As will be described in greater detail below the ice makers according to applicants' inventions can be used with side by side and bottom freezer refrigerator freezers.

Figure 1B:
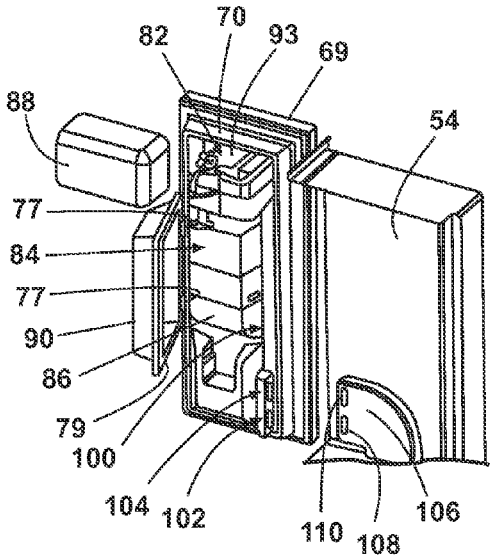
FIG. 1B is a partial perspective view of the bottom freezer refrigerator illustrated in FIG. 1A with a refrigerator compartment door open illustrating an ice maker according to the invention positioned on the door above an ice cube storage bin and ice dispenser.
Figure 2:
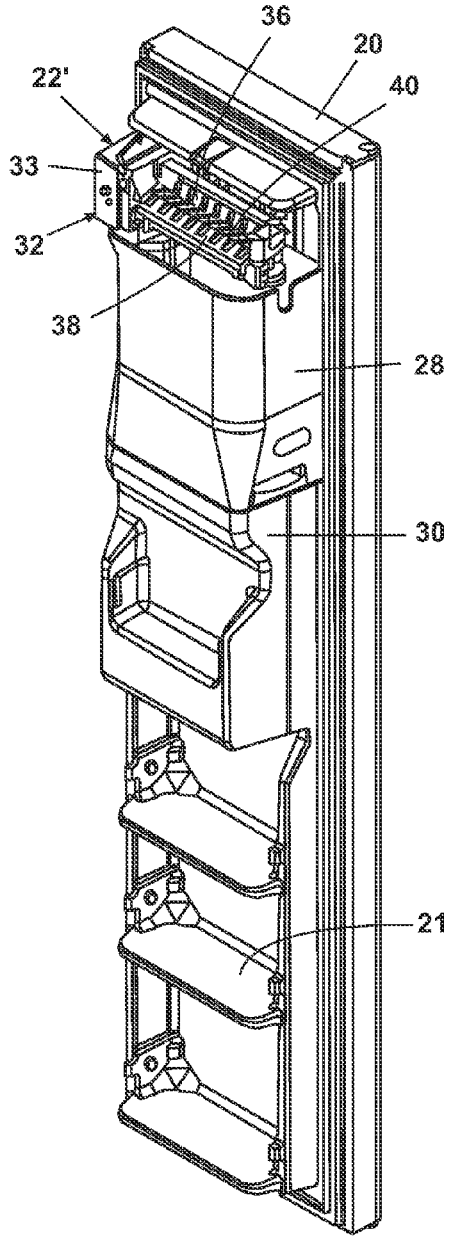
FIG. 2 is a perspective view of a freezer door illustrating the application of an ice maker according to the invention to a side by side refrigerator freezer.
Figure 12A:
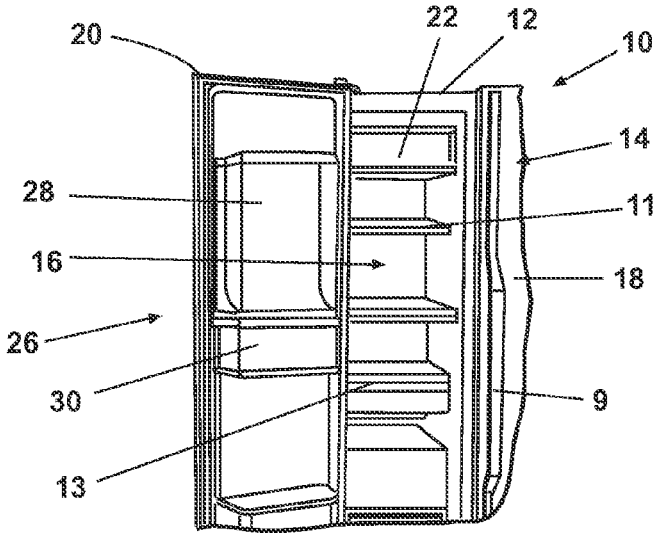
Fig 12A (PRIOR ART)
FIG. 12A is a partial perspective view of a prior art side by side refrigerator freezer having the ice maker positioned in the freezer compartment.
Figure 12B:
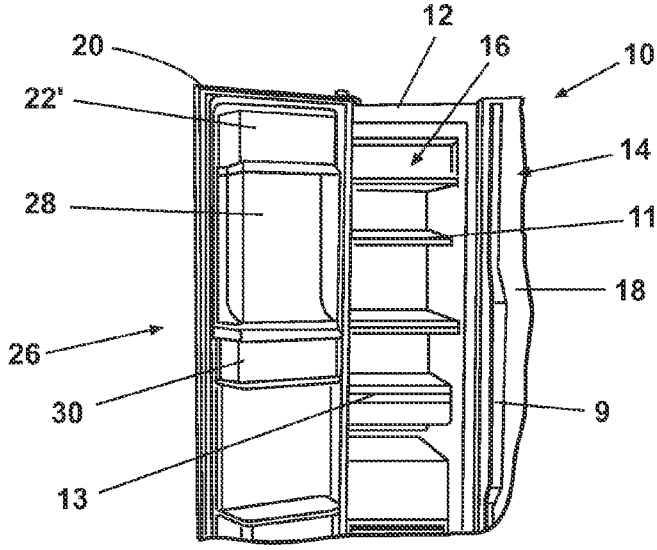
FIG. 12B is a partial perspective view of a side by side refrigerator freezer having an ice cube maker according to the invention positioned on the freezer compartment door.

Turning to FIGS. 1A, 1B, 2, 12A and 12B bottom freezer and side by side refrigerator freezers having an in the door ice maker and dispenser apparatus according to the invention can be seen. FIGS. 1A and 1B shows a bottom freezer refrigerator disclosed in greater detail in U.S. Patent Application US20040111, now U.S. Pat. No. 7,188,479, filed concurrently with parent U.S. patent application Ser. No. 10/973,559 by Anselmino et al, and entirely incorporated by reference in this application. Bottom freezer refrigerator 50 can have a cabinet 52 including a refrigerator compartment 54 maintained at above 0° C. temperatures and a freezer compartment 56 maintained at below 0° C. temperatures. Freezer compartment 56 is positioned in the bottom of cabinet 52 and refrigerator compartment 54 is positioned above freezer compartment 56. In the embodiment of FIGS. 1A and 1B, bottom freezer 50 can have two refrigerator compartment doors 68 and 69 arranged side by side. The bottom freezer refrigerator 50 configuration shown in FIGS. 1A and 1B is sometimes referred to as a French door bottom mount refrigerator freezer. Conventional door handles 44, 46 and 48 are shown on refrigerator compartment doors 68 and 69 and freezer compartment door 66. Those skilled in the art will readily understand that different handles, or no handles, can be provided for the doors as is well known in the art. A side by side refrigerator freezer embodying the invention is illustrated in FIGS. 2, 12A and 12B and described in detail below.

Refrigerator 50 can have a refrigeration system (not shown) for cooling the refrigerator compartment 54 and freezer compartment 56. The refrigeration system can include a compressor, condenser, evaporator and expansion device, all not shown, as is well known in the art. The compressor can be a variable speed compressor to provide variable cooling rates, again well known in the art. Refrigerator 50 can also have a control system (not shown) that can include temperature sensors (not shown) for the refrigerator compartment 54 and freezer compartment 56 connected to refrigerator and freezer compartment temperature controllers (not shown) to maintain the temperatures in the respective compartments at user selected temperatures. The evaporator (not shown) can be positioned in an evaporator compartment (not shown) that can be positioned along the back wall of the freezer compartment as is well known in the art.

Refrigerator compartment door 69 can include an ice and water dispenser 72 positioned on the face of the door. Ice and water dispenser 72 can be positioned on refrigerator compartment door 69 at a convenient height for user access as is well known in the art. A user interface 73 can be positioned adjacent ice and water dispenser 72 for users to select ice and water dispensing alternatives such as "quick ice" described below, and other refrigerator freezer operation parameters such as described U.S. Pat. No. 7,201,005 incorporated herein by reference.

An ice maker 82 can be mounted adjacent the top of refrigerator compartment door 69 spaced from inner door panel 70. An ice cube storage bin 84 can be positioned below ice maker 82 and arranged so that ice cubes harvested from ice maker 82 can fall through gap 93 into ice cube storage bin 84. Gap 93 can be provided between the rear of ice maker 82 and inner door 70 to direct ice cubes into ice cube storage bin 84. Ice cube storage bin 84 can rest on top of ice dispenser 86. An insulated cover 88 can be provided to substantially enclose ice maker 82. An insulated cover 90 can be provided to substantially enclose ice cube storage bin 84 and ice dispenser 86. Insulated covers 88 and 90 can form sub-compartments that can be maintained below 0° C. to facilitate formation and storage of ice cubes. Insulated cover 88 can include one or more latching surfaces (not shown) arranged to hold cover 88 in place forming a below 0° C. enclosure for ice maker 82 as refrigerator compartment door 69 is opened and closed in use. As described above, insulated cover 88 and insulated cover 90 allow the respective sub-compartments to be maintained at below 0° C. temperatures without upsetting normal above 0° C. temperatures in refrigerator compartment 54.

Insulated cover 90 can be pivotally mounted to inner door panel 70 with hinges 77. Hinging insulated cover 90 to inner door panel 70 can allow easy access to ice cube storage bin 84 to, for example, facilitate removal of ice cube storage bin 84 to bulk dispense ice cubes into a cooler or the like. Insulated cover 90 can be arranged so that it can be closed automatically as refrigerator compartment door 69 is closed. Insulated cover 90 can be provided with a gasket 79 to seal against a surface of inner door panel 70.

Insulated cover 90 can be omitted if ice cube storage bin 84 is formed of insulating material. In one embodiment, ice cube storage bin 84 can be formed of double wall plastic material with sufficient insulating properties to maintain ice cubes in the bin frozen and sufficiently cold to preclude individual cubes from melting together. Those skilled in the art will readily understand that suitable clear plastic materials such as described above can be used to form an insulated ice cube storage bin 84. Similarly, those skilled in the art will understand that if no insulating cover is provided below 0° C. air flow can be directed into ice cube storage bin 84 in a manner to preclude undesirable leakage to the refrigerator compartment.

Ice cube storage bin 84 and ice dispenser 86 can be similar to the ice delivery system disclosed in U.S. Pat. No. 6,082,130, assigned to the assignee of this application and incorporated herein by reference. Those skilled in the art will understand that an ice delivery system such as disclosed in U.S. Pat. No. 6,082,130 can be used in the embodiment shown in FIGS. 1A and 1B, or can be provided with an insulating ice cube storage bin as described above, and can be positioned on refrigerator compartment door to cooperate with ice maker 82 and with ice and water dispenser 72. One approach to ice cube storage bin level sensing is described in U.S. Pat. No. 6,082,130 and those skilled in the art will understand that many ways to determine the level of ice cubes in an ice cube storage bin are known and can be used in place of the optical system described in the above identified patent application. Ice maker 82 and the ice and water dispenser 72 can be provided with water under control of a water valve control 94 and a water valve 95 that can be included in the bottom freezer refrigerator as is well known in the art. The water valve control 94 for the ice and water dispenser 72 and ice maker 82 can be a variable flow water system as disclosed in U.S. Pat. No. 7,210,601 incorporated herein by reference.

In a bottom freezer embodiment as illustrated in FIGS. 1A and 1B below 0° C. air can be supplied to ice maker 82 and ice cube storage bin 84 by an air delivery system that can lead from freezer compartment 56. The air delivery system can include a first air delivery portion 100 that can be positioned along one side of refrigerator compartment door 69 against inner door panel 70. The air delivery system can include a second air delivery portion 106 positioned along a side wall of refrigerator compartment 54 and leading down toward freezer compartment 56. First air delivery portion 100 can include a supply duct 102 and a return duct 104. Those skilled in the art will understand that first air delivery portion 100 can be a dual passage tube having two air passages forming supply duct 102 and return duct 104. First air delivery portion 100 can be formed of thermoformed or injection molded plastic material and can be covered or enclosed with insulating material such as rigid styrobead. Second air delivery portion 106 can similarly comprise a supply duct 108 and a return duct 110. Second air delivery portion 106 can be a dual passage tube formed of plastic material similar to first air delivery portion 100. The faces of first and second air delivery portions 100 and 106 can abut when refrigerator door 69 is closed and can be arranged so that supply ducts 102 and 108 and return ducts 104 and 110 are opposite one another, and can form a continuous passage when refrigerator compartment door 69 is closed. The face of first and second air delivery portions 100 and 106 can include suitable sealing surfaces for the supply and return ducts so that substantially air tight connections can be made when refrigerator compartment door 69 is closed. The air delivery system is described in greater detail in U.S. Pat. No. 7,188,479 incorporated by reference as indicated above.

Turning to FIGS. 2 and 12B a side by side refrigerator freezer having an in the door ice maker and dispenser apparatus according to the invention can be seen. FIG. 12A illustrates a prior art side by side refrigerator freezer 10 having an ice maker assembly 22 positioned in the top of freezer compartment 16. Freezer compartment 16 can have one or more shelves 11 and one or more baskets 13 arranged for storing items in the freezer compartment 16. Freezer compartment door 20 can have one or more door shelves 21 arranged for storing items on the freezer compartment door 20. Similarly, refrigerator compartment 14 can have one or more shelves and one or more baskets or bins for storing items in the above 0° C. refrigerator compartment. FIG. 12B illustrates a side by side refrigerator freezer 10 having an ice maker assembly 22' according to the invention positioned on the inside of freezer compartment door 20. Comparing FIGS. 12A and 12B relocation of ice maker assembly 22 to the freezer door 20 can result in a full additional shelf for increased storage in freezer compartment 16 with no decrease in freezer door 20 shelf storage space. Side by side refrigerator freezer 10 can be provided with a cabinet 12 forming a refrigerator compartment 14 and a freezer compartment 16 arranged side by side as is well known in the art. A refrigeration system (not shown) can be provided to maintain refrigerator compartment 14 at temperatures above 0° C. and freezer compartment 16 at temperatures below 0° C. as is well known in the art. A refrigerator compartment door 18 and a freezer compartment door 20 can be provided to provide access to the refrigerator freezer. Freezer compartment door 20 can have an ice and water dispenser similar to ice and water dispenser 72 described above. In prior art side by side refrigerators as illustrated in FIG. 12A, ice maker assembly 22 is positioned in the top of freezer compartment 16 and is arranged to discharge ice cubes into an ice cube storage bin 28. Ice maker assembly 22' can include an ice maker 32 having an ice mold 36, an ice stripper 38 and an ice rake 40. Ice maker 32 can have an ice maker control 33 that can include a motor 35 (FIG. 27) for operating the ice rake. Ice dispensing system 26 can be positioned on door 20 below ice maker assembly 22'. Ice dispensing system 26 can include ice bin 28 that can be positioned on ice crusher 30. Ice crusher 30 can be arranged to dispense cubed or crushed ice through an ice and water dispenser (not shown in FIG. 12A or 12B) on the face of freezer compartment door 20. The ice dispenser illustrated in FIGS. 2, 12A and 12B can be similar to the ice dispensing system described in U.S. Pat. No. 6,082,130 incorporated herein in its entirety. When operated, the ice dispensing system 26 transfers ice cubes or pieces from ice cube storage bin 28 through the freezer compartment door 20 whereby ice cubes can be dispensed through a conventional ice and water dispenser similar to ice and water dispenser 72 described above.

Figure 3:
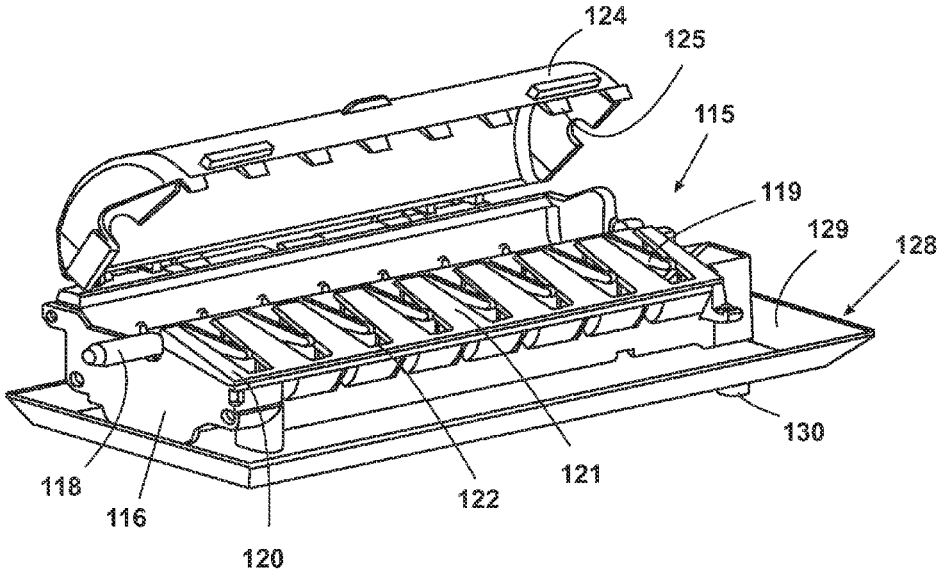
FIG. 3 is a perspective view on one embodiment of an ice maker according to the invention having a tray for catching spills and a cover.
Figure 4:
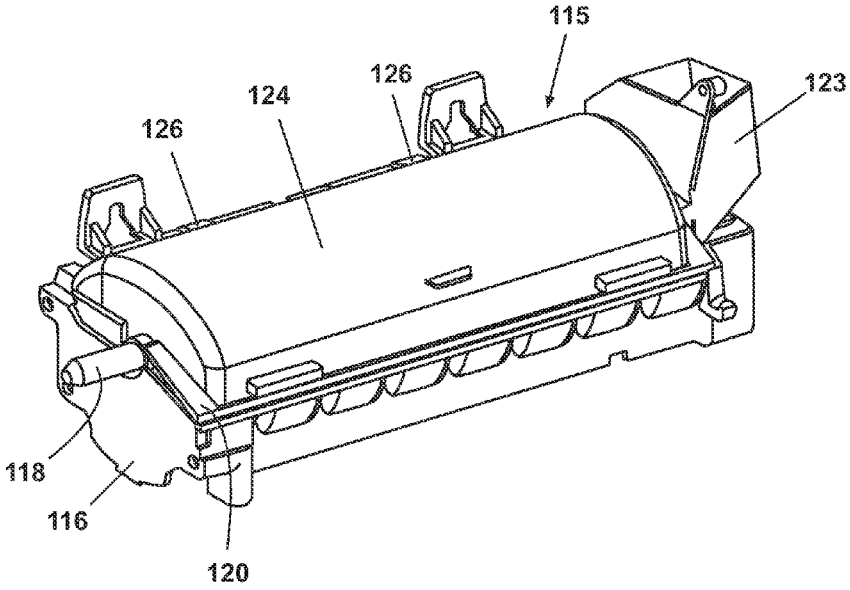
FIG. 4 is a perspective view of the ice maker of FIG. 3 with the cover closed.

Next several embodiments will be described of ice makers embodying applicants' invention. Each of the embodiments can allow the respective ice makers to be positioned and operated on a freezer compartment door 20 of a side by side refrigerator freezer or on a refrigerator compartment door 69 of a bottom freezer refrigerator. Turning to FIGS. 3 and 4, one embodiment of an ice maker for use on a refrigerator or freezer compartment door can be seen. Ice maker 115 can be an ice maker similar to the ice maker disclosed in U.S. Pat. Nos. 4,649,717 and 4,649,718 incorporated herein by reference. Ice maker 115 can comprise an ice mold 116 that can be an epoxy coated cast aluminum mold as are well known in the art. Ice mold 116 can have a heater 117 (FIG. 27) provided to heat the mold during ice harvesting cycles as described in the above identified patents incorporated by reference. Ice mold 116 can be provided with an ice stripper 120 having a plurality of stripper fingers 121 extending over one side of ice mold 116. An ice rake or ice ejector 118 can be rotatably mounted at the center of the top edge of ice mold 116. Ice rake 118 can include a plurality of tines 119 to eject ice cubes from ice mold 116 as ice rake is rotated through ice mold 116 during an ice harvesting cycle. Ice maker 115 can have a water inlet element 123 (see FIG. 4) to direct water from an ice maker fill tube (not shown) into ice mold 116 as is well known in the art. Ice maker 115 can have a control housing (not shown) as described in the above referenced U.S. patents having a control 33 (FIG. 27) controlling operation of ice maker 115 and a motor 35 (FIG. 27) driving ice rake 118 during ice harvesting cycles all as is well known in the art. Ice mold 116 can be provided with a cover 124 that can be hinged to the edge of ice mold 116 opposite ice stripper 120. Cover 124 can have a plurality of tongues 125 extending from one edge of cover 124 arranged to substantially close the gaps 122 between adjacent stripper fingers 121 when cover 124 is closed against the top edge of ice mold 116 and ice stripper 120. Thus, cover 124 can be arranged to substantially enclose ice mold 116 to help prevent water from spilling out of ice mold 116 in the event the refrigerator or freezer compartment door on which ice maker 115 is positioned is abruptly opened or closed when liquid water is present in ice mold 116. Cover 124 can be arranged to be opened during an ice harvest cycle by the ice maker control (not shown). For example, a cam or other drive mechanism (not shown) can be arranged to drive cover 124 to the open position shown in FIG. 3 as control drives ice rake 118 through ice mold 116 to eject ice cubes from the ice mold. Alternately, cover 124 could be resiliently biased to the open position shown in FIG. 3 and the ice maker control (not shown) could operate to close cover 124 other than during an ice harvesting cycle as will be readily understood by those skilled in the art.

Further protection against spillage of water from ice maker 115 can be provided by mounting ice maker 115 on a tray 128 having upturned walls 129 along the edge of tray 128 to contain any water that might spill from ice maker 115. Tray 128 can be provided with a drain 130 to drain any water spilled into tray 128 to a disposal container (not shown) that can be positioned on a refrigerator door or elsewhere in the refrigerator freezer. The disposal container can be arranged for manual emptying by a user or can be provided with a drain pump 292 to empty the container (step 309, FIG. 26). A drain line (not shown) can lead from drain 130 to a disposal container that can be located in the machinery compartment 58 (FIG. 1A) that is located at the bottom of refrigerator freezers in which a compressor and condenser and other components for the refrigerator freezer are typically located as is well known in the art. The disposal container can be the typical drain pan 60 (see FIG. 23) that can be located beneath the condenser 64 (FIG. 23) for evaporating water melting from the evaporator (not shown) during defrost cycles again as well known in the art. Those skilled in the art will understand that other water disposal containers can be provided, or that a connection arranged to connect to a household drain can be provided if desired. Tray 128 can also be provided with a heater 132 (FIG. 27) to periodically heat tray 128 to evaporate any water that may have spilled into tray 128 or alternately to melt any ice that forms in tray 128 from water spilled into tray 128. The operation of heater 132 will be described in greater detail below in connection with FIGS. 26 and 27. Tray 128 can also be provided with a drain pump 292 (FIG. 27) that can be connected to drain 130 to pump water from tray 128 to a disposal container that is not located below tray 128 to allow for a gravity drain.

Figure 5:
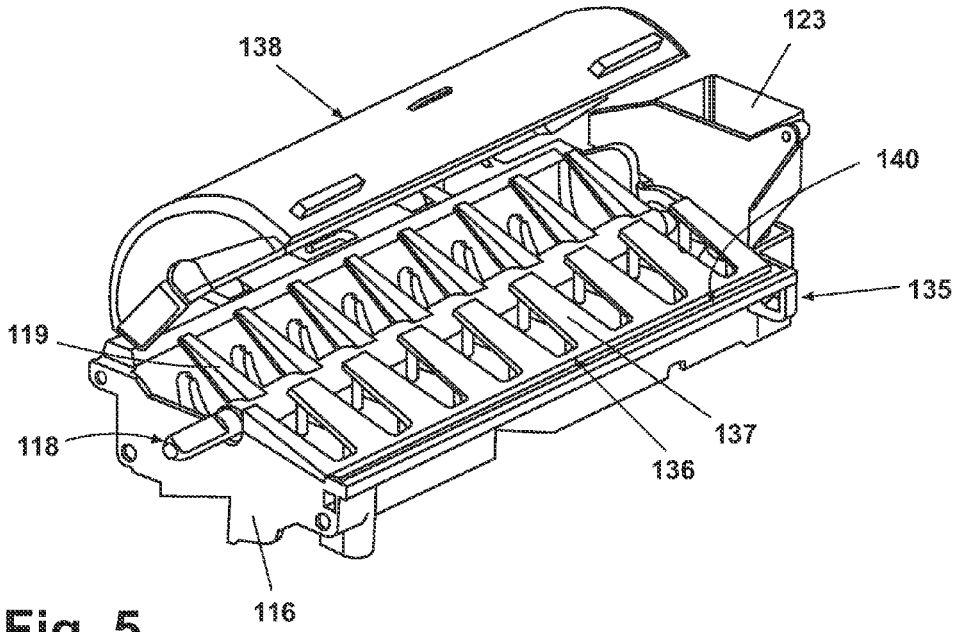
FIG. 5 is a perspective view of another embodiment of an ice maker according to the invention having a cover and a water recovery channel.
Figure 6:
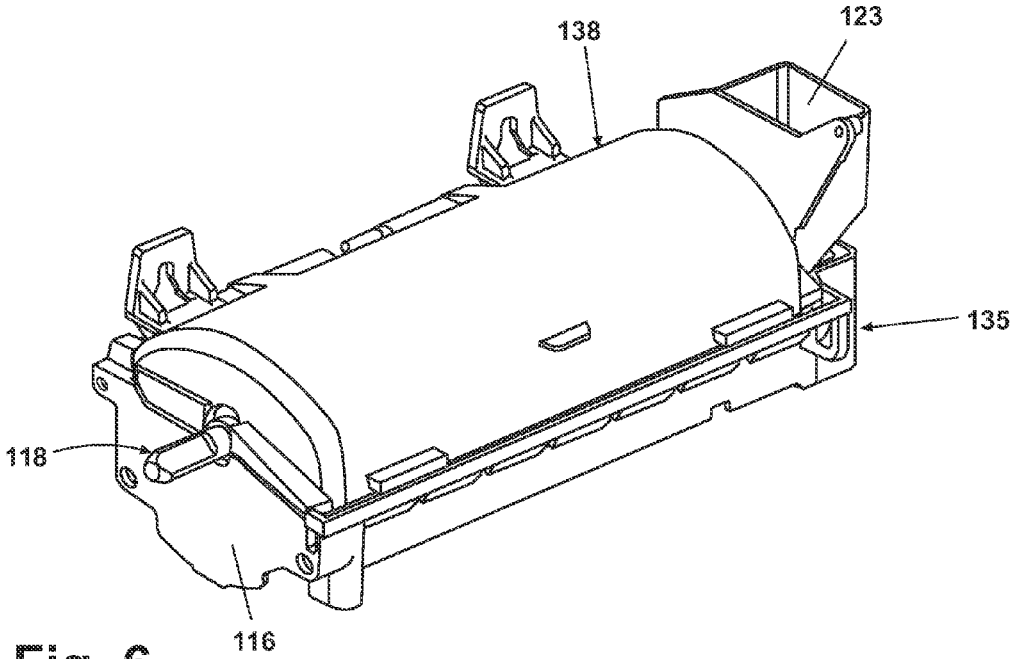
FIG. 6 is a perspective view of the ice maker of FIG. 5 with the cover closed.

Turning to FIG. 5 and FIG. 6 another embodiment of an ice maker for use on a refrigerator or freezer compartment door can be seen. Ice maker 135 can be an ice maker similar to the ice maker disclosed in U.S. Pat. Nos. 4,649,717 and 4,649,718 incorporated herein by reference. Ice maker 135 can comprise an ice mold 116 that can be an epoxy coated cast aluminum mold as are well known in the art. Ice mold 116 can have a heater 117 provided to heat the mold during ice harvesting cycles as described in the above identified patents incorporated by reference. Ice mold 116 can be provided with an ice stripper 136 having a plurality of stripper fingers 137 extending over one side of ice mold 116. An ice rake or ice ejector 118 can be rotatably mounted at the center of the top edge of ice mold 116. Ice rake 118 can include a plurality of tines 119 to eject ice cubes from ice mold 116 as ice rake is rotated through ice mold 116 during an ice harvesting cycle. Ice maker 135 can have a water inlet element 123 to direct water from an ice maker fill tube (not shown) into ice mold 116 as is well known in the art. Ice maker 135 can have a control housing (not shown) as described in the above referenced U.S. patents including a control 33 for controlling operation of ice maker 135 and a motor 35 for driving ice rake 118 during ice harvesting cycles all as is well known in the art. Ice mold 116 can be provided with a cover 138 that can be hinged to the edge of ice mold 116 opposite ice stripper 136. Ice stripper 136 and the edge of ice mold 116 can define a water recovery channel 140 between the top edge of ice mold 116 and ice stripper 136. When cover 138 is in the closed position shown in FIG. 6 the top of water recovery channel 140 is closed so that any water splashing up from ice mold 116 against stripper 136 or cover 138 can flow into water recovery channel 140 and then back into ice mold 116. In other respects ice maker 135 can operate like ice maker 115 described above and can be arranged for cover 138 to open during ice harvesting cycles. Those skilled in the art will understand that a tray 128 can be provided for ice maker 135 as described above in connection with FIGS. 3 and 4.

Figure 7:
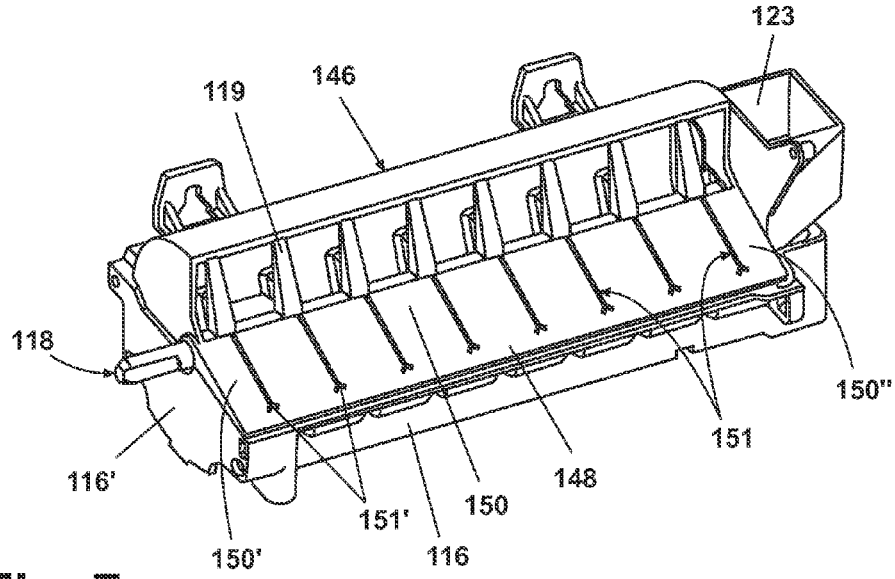
FIG. 7 is a perspective view of another embodiment of an ice maker according to the invention having a flexible ice stripper and a partial hood.

Turning to FIG. 7, another embodiment of an ice maker for use on a refrigerator or freezer compartment door can be seen. Ice maker 145 can be an ice maker similar to the ice maker disclosed in U.S. Pat. Nos. 4,649,717 and 4,649,718 incorporated herein by reference. Ice maker 145 can comprise an ice mold 116 that can be an epoxy coated cast aluminum mold as are well known in the art. Ice mold 116 can have a heater 117 provided to heat the mold during ice harvesting cycles as described in the above identified patents incorporated by reference. In the embodiment of FIG. 7 member or strip 148 can have a plurality of fingers 150 and can be formed of flexible material such as silicon rubber and can have a plurality of slits 151 that can be aligned with tines 119 of ice rake 118. Slits 151 can terminate in cross slits 151'. An ice rake or ice ejector 118 can be rotatably mounted at the center of the top edge of ice mold 116. Ice rake 118 can include a plurality of tines 119 to eject ice cubes from ice mold 116 as ice rake is rotated through ice mold 116 during an ice harvesting cycle. As tines 119 contact member or strip 148 the edges of adjacent fingers 150 can deflect to allow the respective tines to move through slits 151 and eject ice cubes from the ice mold 116. Thus, member or strip 148 and fingers 150 can be an ice stripper. Member or strip 148 can have end fingers 150' and 150" that can contact end walls 116' of ice mold 116. Ice maker 145 can have a water inlet element 123 to direct water from an ice maker fill tube (not shown) into ice mold 116 as is well known in the art. Ice maker 145 can have a control housing (not shown) as described in the above referenced U.S. patents including a control 33 for controlling operation of ice maker 145 and a motor 35 for driving ice rake 118 during ice harvesting cycles all as is well known in the art. Ice maker 145 can have a fixed hood 146 connected to ice mold 116 opposite member or strip 148 to substantially cover the side of ice mold 116 opposite member or strip 148. Thus, the combination of member or strip 148 and hood 146 can substantially cover the open top of ice mold 116 and can substantially reduce the chance of water splashing out of ice mold 116 should the door on which ice maker 145 is mounted be abruptly opened or closed when liquid is present in ice mold 116. Those skilled in the art will understand that a tray 128 can be provided for ice maker 145 as described above in connection with FIGS. 3 and 4.

Figure 8:
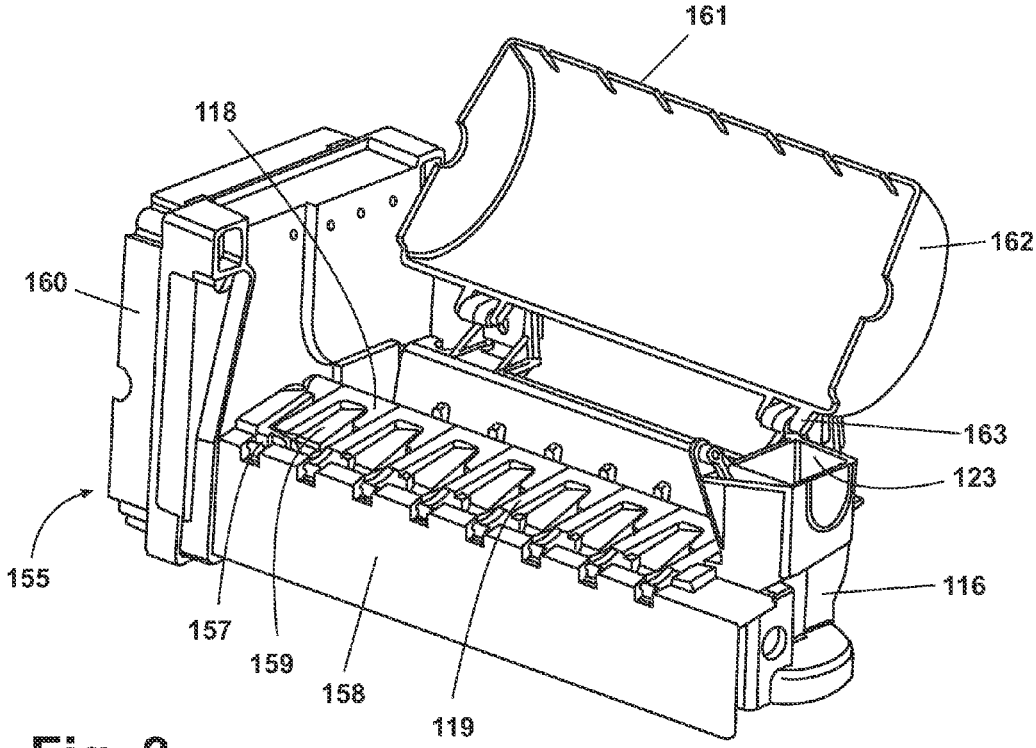
FIG. 8 is a perspective view of another embodiment of an ice maker according to the invention having a cover.

Turning to FIG. 8, another embodiment of an ice maker for use on a refrigerator or freezer compartment door can be seen. Ice maker 155 can be an ice maker similar to the ice maker disclosed in U.S. Pat. Nos. 4,649,717 and 4,649,718 incorporated herein by reference. Ice maker 155 can comprise an ice mold 116 that can be an epoxy coated cast aluminum mold as are well known in the art. Ice mold 116 can have a heater 117 provided to heat the mold during ice harvesting cycles as described in the above identified patents incorporated by reference. Ice mold 116 can be provided with an ice stripper 158 having a plurality of stripper fingers 159 extending over one side of ice mold 116. An ice rake 118 can be rotatably mounted at the center of the top edge of ice mold 116. Ice rake 118 can include a plurality of tines 119 to eject ice cubes from ice mold 116 as ice rake is rotated through ice mold 116 during an ice harvesting cycle. Ice maker 115 can have a water inlet element 123 to direct water from an ice maker fill tube (not shown) into ice mold 116 as is well known in the art. Ice maker 155 can have a control housing 160 as described in the above referenced U.S. patents including a control 33 for controlling operation of ice maker 155 and a motor 35 for driving ice rake 118 during ice harvesting cycles all as is well known in the art. Ice mold 116 can be provided with a cover 162 that can be hinged to the edge of ice mold 116 opposite ice stripper 158. Cover 162 can be hinged to ice mold 116 with a pair of hinges 163. Cover 162 can have a plurality of tongues 161 extending from one edge of cover 162 arranged to substantially close the gaps 157 between adjacent stripper fingers 159 when cover 162 is closed against the top edge of ice mold 116 and ice stripper 158. Thus, cover 162 can be arranged to substantially enclose ice mold 116 to help prevent water from spilling out of ice mold 116 in the event the refrigerator or freezer compartment door on which ice maker 155 is positioned is abruptly opened or closed when liquid water is present in ice mold 116. Cover 162 can be arranged to be opened during an ice harvest cycle by the ice maker control 160. For example, a cam or other drive mechanism (not shown) can be arranged to drive cover 162 to the open position as control drives ice rake 118 through ice mold 116 to eject ice cubes from the ice mold. Alternately, cover 162 could be resiliently biased to the open position and the ice maker control 160 could operate to close cover 162 other than during an ice harvesting cycle as will be readily understood by those skilled in the art. Those skilled in the art will understand that a tray 128 can be provided for ice maker 155 as described above in connection with FIGS. 3 and 4.

Figure 9:
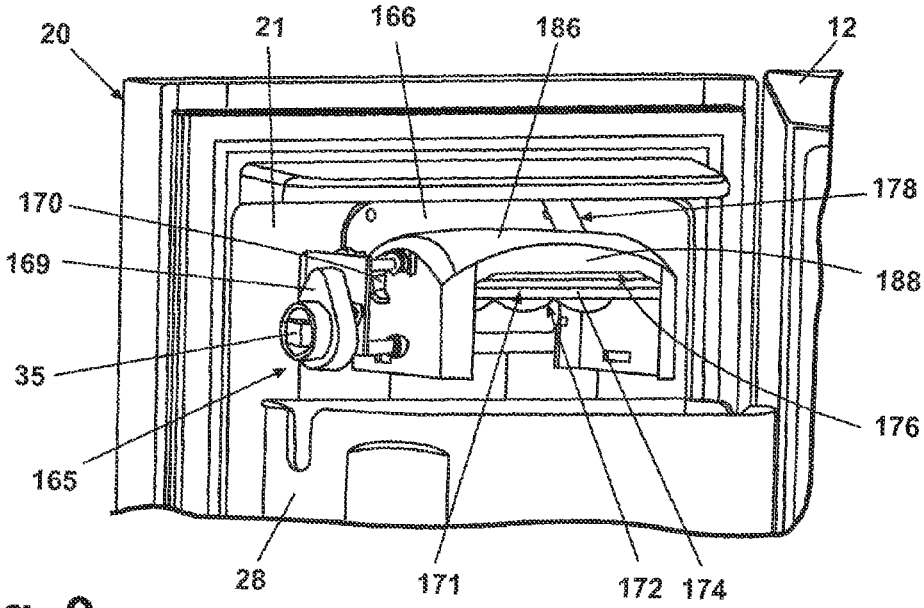
FIG. 9 is a partial perspective view of another embodiment of an ice maker according to the invention positioned on a refrigerator compartment or freezer compartment door with the ice mold in the closed position.
Figure 10:
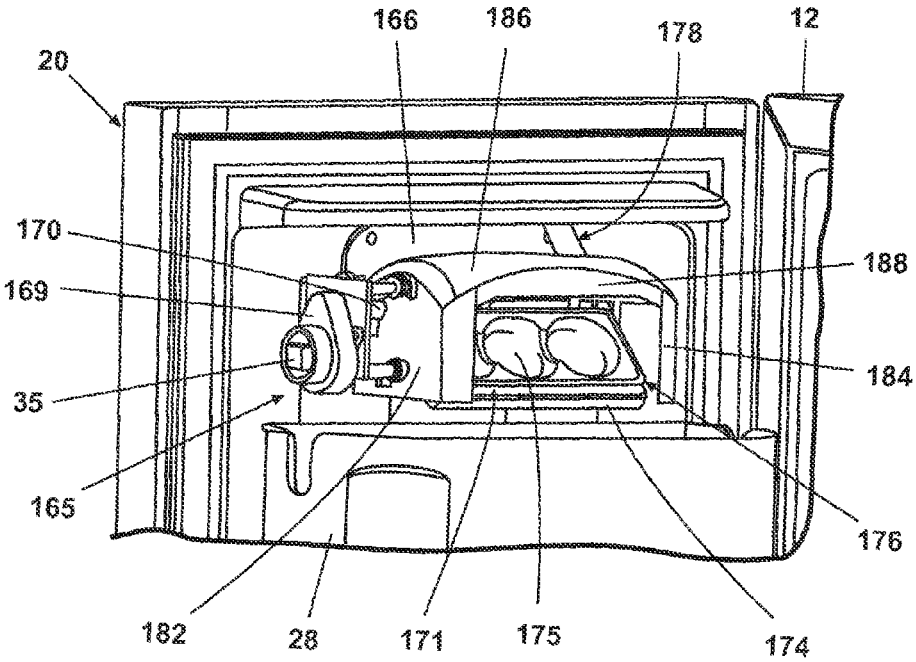
FIG. 10 is a partial perspective view of the ice maker of FIG. 9 with the ice mold partially open.
Figure 11:
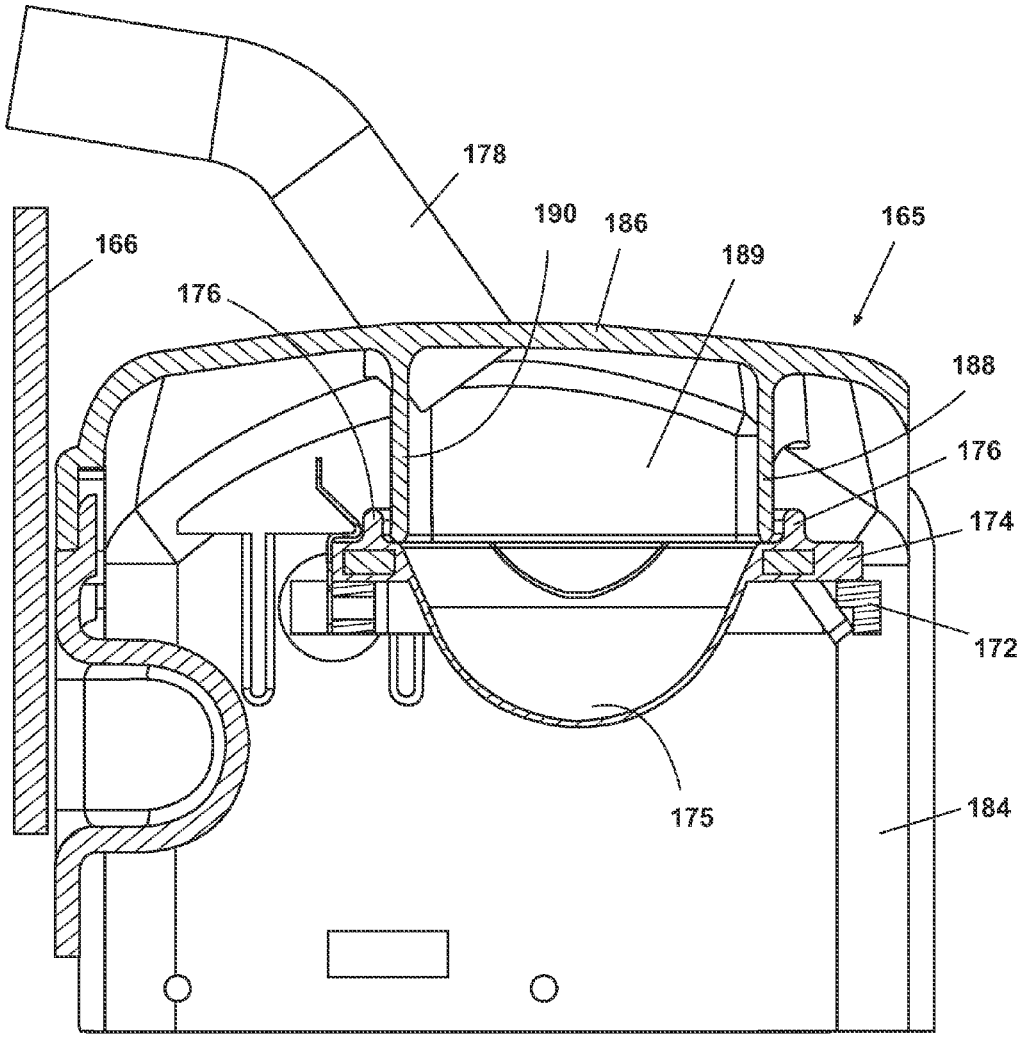
FIG. 11 is a cross sectional view through the ice maker of FIG. 9 illustrating the relationship between the ice mold and the housing in the closed position.

Turning to FIGS. 9, 10 and 11, another embodiment of an ice maker for use on a refrigerator or freezer compartment door can be seen. In the embodiment of FIGS. 9, 10 and 11 ice maker 165 is illustrated on a freezer compartment door 20 as in FIG. 2. Those skilled in the art will understand that ice maker 165 could also be utilized on a refrigerator compartment door 69 as in the embodiment illustrated in FIGS. 1A and 1B. Ice maker 165 can be similar to the ice maker disclosed in U.S. Patent Applications US20020155 and US20040162, now U.S. Pat. Nos. 7,185,508 and 7,188,479, filed concurrently with parent U.S. patent application Ser. No. 10/973,559 by Voglewede et al, which patents are incorporated in their entirety by reference. Ice maker 165 is shown in the closed, filling and ice forming position in FIG. 9. In FIG. 10 ice maker 165 is shown partially rotated to the ice harvesting position to illustrate spill management aspects of this embodiment of the invention. FIG. 11 is a cross sectional view of ice maker 165 in the closed filling and ice forming position as shown in FIG. 9. Ice maker 165 can be attached to door 20 by attaching mounting plate 166 to inner door 21 as will be understood by those skilled in the art. Ice maker 165 can include a housing 180 having end walls 182 and 184 and a top wall 186. End walls 182 and 184 can rotatably support ice tray 171. Ice tray 171 can comprise a frame 172 that can support a mold insert 174. As disclosed in U.S. Pat. Nos. 7,185,508 and 7,188,479 incorporated herein by reference as indicated above, mold insert 174 can be a flexible plastic material that can include polyurethane and silicone that can have a low friction material forming the top layer. End wall 182 can support a motor 35 that can include a gear train (not shown) in housing 169 that can connect motor 35 to a drive shaft 170 connected to frame 172. The operation of motor 35 by a control 33 to drive ice tray 171 to harvest ice pieces is described in detail in U.S. Pat. Nos. 7,185,508 and 7,188,479 incorporated herein by reference as indicated above. The embodiment of ice maker 165 arranged for mounting on a refrigerator or freezer compartment door can be arranged to preclude spills of water in the event the door on which ice maker 165 is mounted is opened and closed when liquid is present in mold insert 174. In the embodiment illustrated in FIGS. 9, 10 and 11, mold insert 174 can have a lip 176 projecting upwardly from mold insert 174. Lip 176 can be positioned outboard of recesses 175. Top wall 186 of housing 180 can include containment walls 188, 189, 190 and 191 (not shown) that can project downward from top wall 186 and can terminate at the top surface of mold insert 174 between recesses 175 and lip 176. Containment wall 191 (not shown) is opposite containment wall 189. Thus, the interaction of containment walls 188, 189, 190 and 191 and lip 176 can substantially preclude splashing of spilling of water out of ice cube tray 171 when unfrozen water is present in recesses 175 and freezer door 20 is abruptly opened or closed.

Figure 14A:
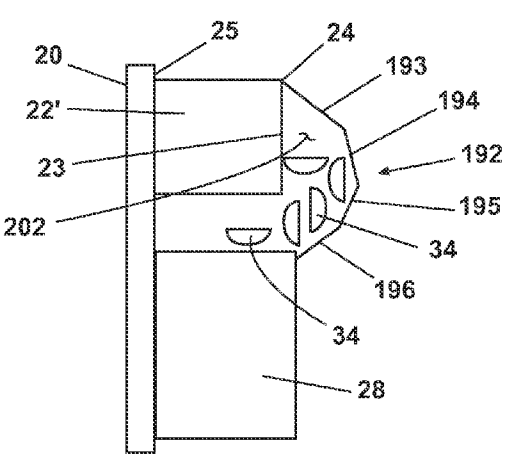
FIG. 14A is a schematic side view illustrating the ice maker of FIGS. 13A and 13B with the cover opened and ice cubes falling into the underlying ice cube storage bin.
Figure 14B:
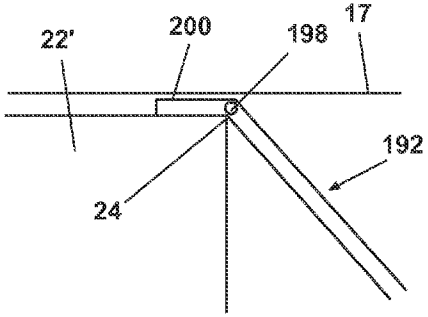
FIG. 14B is a partial schematic side view similar to FIG. 13B illustrating the hinging of the cover to the ice maker in the freezer compartment door closed position.
Figure 13A:
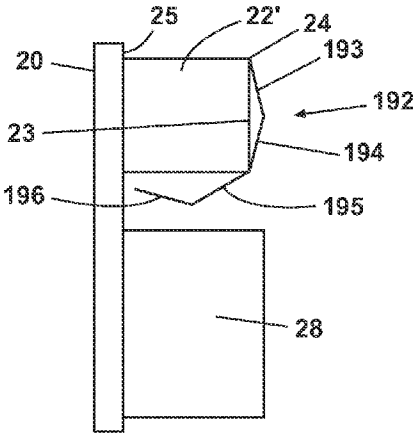
FIG. 13A is a schematic side view illustrating an ice maker according to the invention positioned on a freezer compartment door having a pivotal cover in the closed position.
Figure 13B:
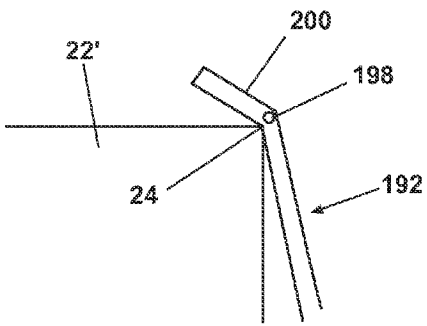
FIG. 13B is a partial schematic side view of the ice maker according to FIG. 13A illustrating the hinging of the cover to the ice maker in the freezer compartment door open position.

Turning to FIGS. 13A, 13B, 14A and 14B, another embodiment of an ice maker for use on a refrigerator or freezer compartment door can be seen in side view schematic form. In FIGS. 13A and 13B freezer door 20 is shown in the open position. In FIGS. 14A and 14B freezer door 20 is shown in the closed position. Those skilled in the art will understand that the embodiment shown in FIGS. 13A, 13B, 14A and 14B can be used in connection with a bottom freezer refrigerator door as shown in the embodiment of FIGS. 1A and 1B. Ice maker 22' can be mounted to the inside surface of freezer compartment door 20 above an ice cube storage bin 28. Ice maker 22' can include a hinged cover 192. In this embodiment hinged cover 192 can comprise a plurality of segments 193, 194, 195 and 196. Hinged cover can be formed of plastic such as polypropylene or metal as will be understood by those skilled in the art. Ice maker 22' can include an open side 23 that can lead to the ice mold portion (not shown) of ice maker 22'. Ice maker 22' can be arranged to discharge ice cubes through open side 23 during harvest cycles. Cover 192 can be hinged at the top edge 24 of ice maker 22' opposite inner door 25 of freezer door 20. Segments 193 and 194 can form a closure for open side 23 when the cover is in the closed position shown in FIG. 13A. Segments 195 and 196 can occupy the space between ice maker 22' and ice cube storage bin 28 when cover 192 is in the closed position as shown in FIG. 13A. When cover 192 is closed ice cube storage bin can be easily removed from inner door 21 for bulk delivery of ice cubes such as for filling a cooler or other purpose as desired without interference from cover 192. Referring to FIG. 13B cover 192 can be hinged to ice maker 22' at top edge 24 by pivot 198. Those skilled in the art will understand that pivot 198 can be a continuous hinge or one or more individual hinges or other known pivotal mounting arrangement. The weight of segments 193, 194, 195 and 196 can bias cover 192 to the closed position and can raise actuator 200 extending beyond pivot 198. Turning to FIGS. 14A and 14B, freezer compartment door 20 can be seen in the closed position. In the closed position actuator 200 can be seen pivoted down into contact with the top of ice maker 22' due to actuator 200 being operated by freezer compartment top wall 17. Movement of actuator to the position shown in FIG. 14B can cause cover 192 to rotate upwards to the raised position shown in FIG. 14A. In the raised position cover 192 can form a passage for harvested ice pieces 34 from ice maker 22' to ice cube storage bin 28. Ice cubes 34 are illustrated as crescents in FIG. 14A. Ice cubes will be referred to as 34 in other embodiments whether or not they are shown as crescents. Those skilled in the art will understand that ice cubes can take shapes as desired, crescent, cylindrical, rectilinear, conical or other regular or specialty shapes. Segments 193 and 194 can deflect ice pieces leaving open side 23 of ice maker 22' directing the ice pieces 34 downward into ice cube storage bin 28. Segments 195 and 196 can complete passage 202 leading from ice maker 22' to ice cube storage bin 28. An additional advantage of cover 192 is that, when freezer compartment door 20 is open, cover 192 effectively encloses ice maker 22' to prevent users from inadvertently contacting portions of ice maker 22' when accessing the interior of freezer compartment 16 and can help retain below 0° C. air around ice maker 22'. In addition, as illustrated in FIG. 13A, the profile of freezer door 20 is reduced compared to the door open position due to the rotation of cover 192 to the closed position when freezer door 20 is opened. Cover 192 allows the profile of freezer door 20 to be reduced to the thickness of ice maker 22' and ice cube storage bin 28 compared to ice maker arrangements that require space between inner door 21 and ice maker 22' for harvested ice pieces to fall through into ice cube storage bin 28. Cover 192 is shown as being gravity operated in the embodiment of FIGS. 13A, 13B, 14A and 14B, however, those skilled in the art will understand that cover 192 can be arranged to be operated by a spring motor or solenoid (not shown) to pivot between the closed and open positions. Those skilled in the art will also readily understand that an operator for cover 192 can be arranged to move cover 192 to the open position when door 20 is closed, or when ice maker 22' is in an ice harvesting cycle as desired.

Figure 15:
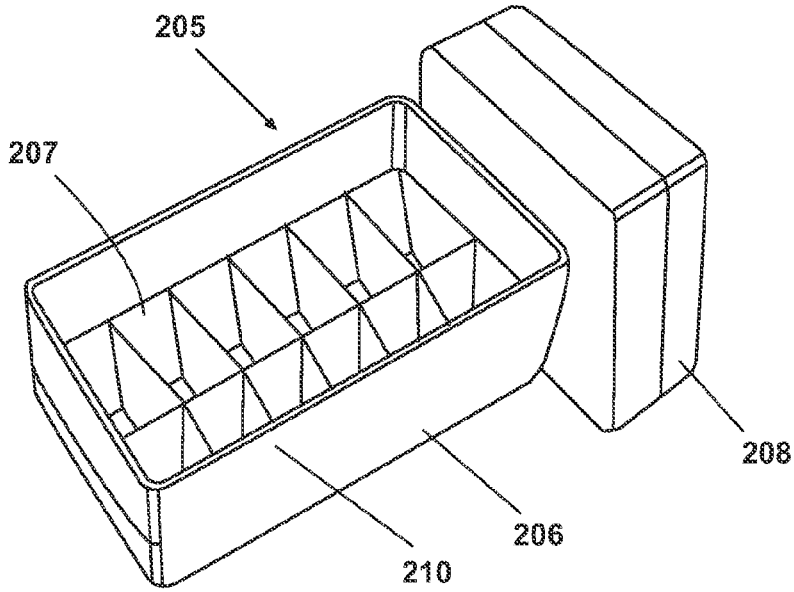
FIG. 15 is a perspective view of another embodiment of twist tray ice maker according to the invention.

Turning to FIG. 15 another embodiment of an ice maker for use on a refrigerator or freezer compartment door can be seen. While ice maker 205 is not shown on a freezer or refrigerator compartment door, those skilled in the art will understand that ice maker 205 can be used in conjunction with the embodiment of FIGS. 1A and 1B or with the embodiment of FIG. 2. Ice maker 205 comprises a twist tray ice maker that can be similar to, and operate similar to the twist tray ice makers disclosed in U.S. Pat. Nos. 3,964,269; 3,871,242; 3,779,032; 3,763,662; 3,727,428; 3,677,030; 3,648,476; 3,383,876 and 3,382,682 all of which are incorporated herein by reference. Twist tray ice maker 205 can include a control housing 208 that can be operatively connected to twist tray 206. Control housing can include a control 33 and a motor 35 to operate twist tray ice maker 205. Twist tray 206 can have side walls 210 that extend upwardly from recesses 207 to form a splash guard to contain unfrozen water in twist tray 206 in the event the door on which ice maker 205 is mounted is abruptly opened or closed. The operation of twist tray ice maker 205 is well known to those skilled in the art and can be similar to the operation of the twist tray ice makers described in the patents described earlier in this paragraph. Ice maker 205 can harvest ice within its own width as is well known in the art. Thus a twist tray ice maker can allow a narrower door profile than ice makers that discharge ice to one side. Ice makers that discharge ice cubes to one side can require an additional width that can be on the order of three inches to allow space for ice cubes to fall into the ice cube storage bin. An additional advantage of a twist tray ice maker is that no ice rake or ice stripper is required over the ice tray. Elimination of an ice rake and ice stripper removes elements that could be exposed to water and freeze in the event the door on which the ice maker is mounted is abruptly opened or closed when unfrozen water is present in the ice mold. Those skilled in the art will understand that ice maker 205 can include appropriate mounting arrangements and can include, for example, a fill tube to supply water to twist tray 206 at the beginning of an ice forming cycle as well as electrical connections to control 208.

Figure 16:
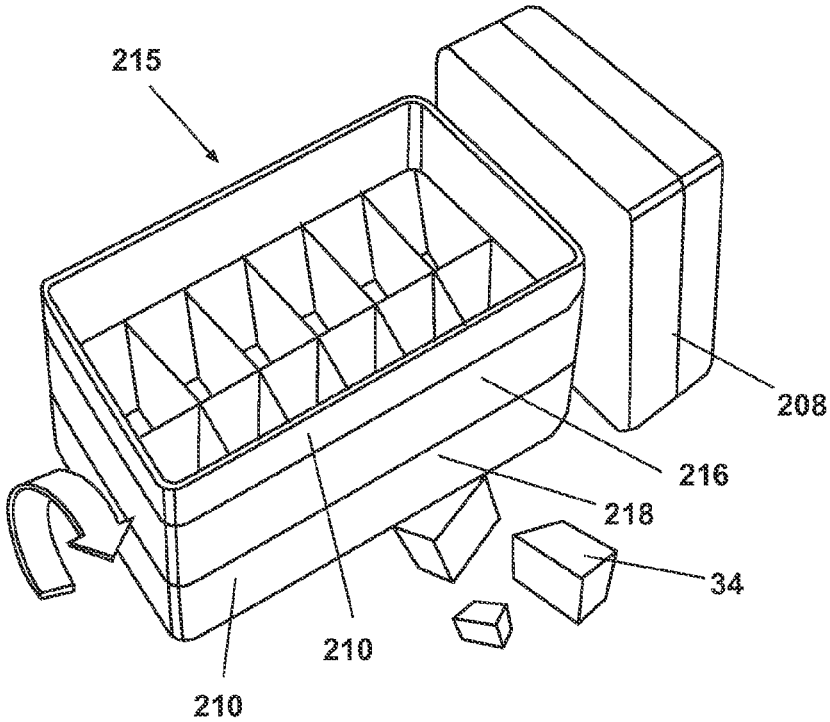
FIG. 16 is a perspective view of another embodiment of a twist tray ice maker according to the invention having two trays.

Turning to FIG. 16 another embodiment of an ice maker for use on a refrigerator or freezer compartment door can be seen. Ice maker 215 can include a top twist tray 216 and a bottom twist tray 218 that can each be generally similar to twist tray 206 in the embodiment of FIG. 15. Each of the top and bottom twist trays can include a splash guard 210 arranged to reduce the chance of unfrozen water splashing out of ice maker 215 in the event the door on which ice maker 215 is mounted is abruptly opened or closed with unfrozen water present in the ice maker. Those skilled in the art will understand that ice maker 215 can include appropriate mounting arrangements and can include, for example, a fill tube to supply water to twist trays 216 and 218 at the beginning of an ice forming cycle as well as electrical connections to control 208. An advantage of a double twist tray is that each twist tray is utilized every other cycle to extend the time before mineral or scale can build up in a tray that can cause ice cubes to stick to the twist tray during harvesting.

Figure 17:
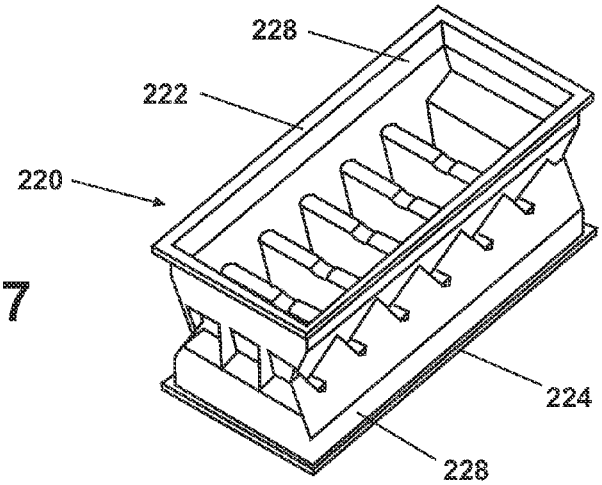
FIG. 17 is a perspective view of another embodiment of a twist tray for use in a twist tray ice maker similar to the embodiments of FIG. 15 and FIG. 16 removed from the ice maker.
Figure 18:
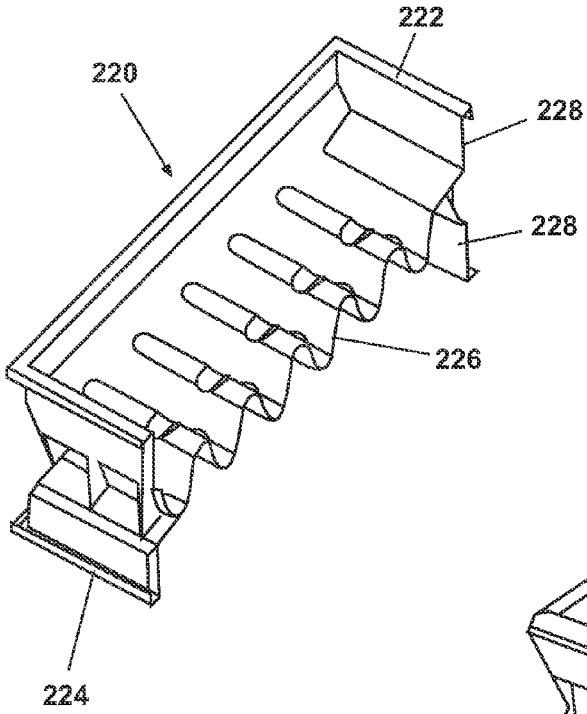
FIG. 18 is a partial sectional view of the twist tray of FIG. 17.
Figure 19:
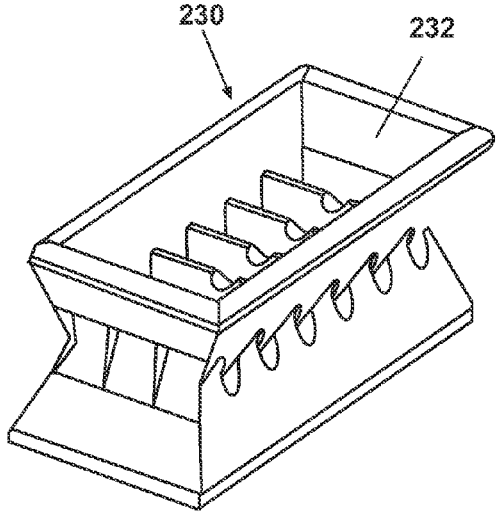
FIG. 19 is a perspective view of another embodiment of a twist tray for use in a twist tray ice maker similar to the embodiments of FIG. 15 and FIG. 16 removed from the ice maker.

FIGS. 17 and 18 illustrate another embodiment of a double twist tray 220 that can have a top twist tray 222 and a bottom twist tray 224. Double twist tray 220 can be used with a twist tray ice maker such as twist tray ice maker 215 described in FIG. 16. Each twist tray 222 and 224 can include a splash guard 228 as described above in connection with the embodiments of FIGS. 15 and 16. In the embodiment of FIGS. 17 and 18 twist tray 220 can comprise a common bottom wall 226 separating top twist tray 222 from bottom twist tray 224. An advantage of providing twist tray 220 with a common bottom wall 226 is that heat in the water added to the empty tray to begin another ice forming cycle can help release any ice cubes that might be stuck in the bottom twist tray. Those skilled in the art will understand that the ice harvesting cycle can be arranged to provide for filling the top twist tray as the empty tray rotates into the upright position to provide heat from the water to help harvest ice cubes in the bottom tray. FIG. 19 illustrates another embodiment of a double twist tray 230 that can be similar to double twist tray 220 in FIGS. 17 and 18. Double twist tray 230 can have a splash guard 232 that can be curved inwardly to help deflect water back into double twist tray 230 in the event the ice maker in which twist tray 230 is utilized is mounted on a refrigerator or freezer door opened of closed abruptly when unfrozen water is present in the ice maker. Those skilled in the art will understand that any of the twist tray embodiments can include a curved splash guard as illustrated in FIG. 19 instead of straight splash guards illustrated in FIGS. 15 to 18. Those skilled in the art will understand that an ice maker incorporating any of the twist tray arrangements illustrated in FIGS. 15 to 19 can operate similar to the twist tray ice makers described in the U.S. patents referenced above in Turning to FIGS. 20A, 20B, 20C, 21A, 21B and 21C, another embodiment of an ice maker for use on a refrigerator or freezer compartment door can be seen. In the embodiment illustrated in FIGS. 20A-C and 21A-C ice maker 240 can comprise an ice mold 242 that can be rotatably mounted to ice maker 240. Ice maker 240 can include a base wall 244 having a motor 35 mounted to one side of base wall 244. Base wall 244 can also support a control 33 (not shown) for controlling operation of ice maker 240. Ice mold 242 can be rotatably mounted between base wall 244 and frame 248. Frame 248 can be a generally "U" shaped member that can be attached to legs 247 that can extend from opposite sides of base wall 244 (frame 248 is omitted from FIG. 20A to better illustrate ice mold 242). Suitable fasteners can be used to attach frame 248 to legs 247 as will be understood by those skilled in the art. Ice mold 242 can be an epoxy coated aluminum mold as described above and can have side walls 250 and 252 that can extend above the water level in ice mold 242 to prevent splashing water out of ice mold 240. Ice mold 242 can include an ice mold heater 117 (FIG. 27) to facilitate removal of ice cubes 34 during the harvesting cycle as is well known. A channel 256 can be formed on side wall 252 to retain water formed as a result of the ice mold heater operation during an ice harvesting cycle. Channel 256 can be formed by a recess 257 is side wall 252 and a lip 258 extending from the distal edge of wall 252 toward the center of ice mold 242. Lip 258 can terminate in return edge 260 extending from the distal end of lip 258 toward the bottom of ice mold 242. A fixed ice rake 254 can be mounted to base wall 244 and frame 248. Ice mold 242 can be arranged to rotate about ice rake 254 as will be described next.

Figure 20C:
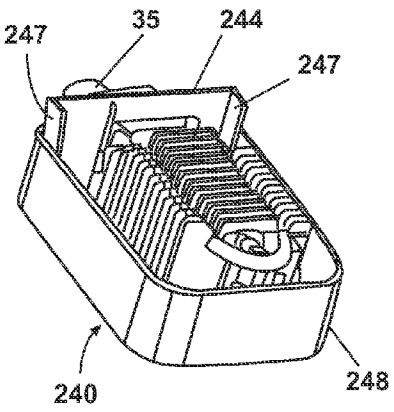
FIG. 20C is a perspective view of the rotatable ice maker mold of FIG. 20A with the mold rotated 180 degrees.
Figure 20B:
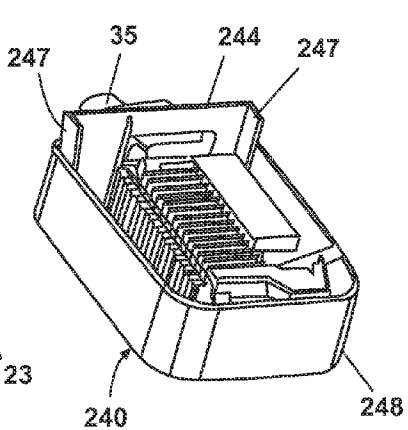
FIG. 20B is a perspective view of the rotatable ice maker mold of FIG. 20A with the mold rotated 90 degrees.
Figure 20A:
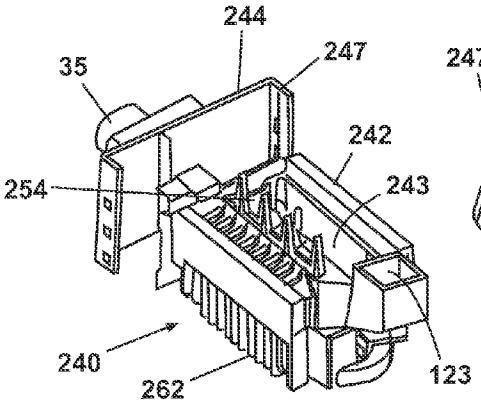
FIG. 20A is a perspective view of another embodiment of a rotatable ice maker mold with the mold in the upright position.
Figure 21C:
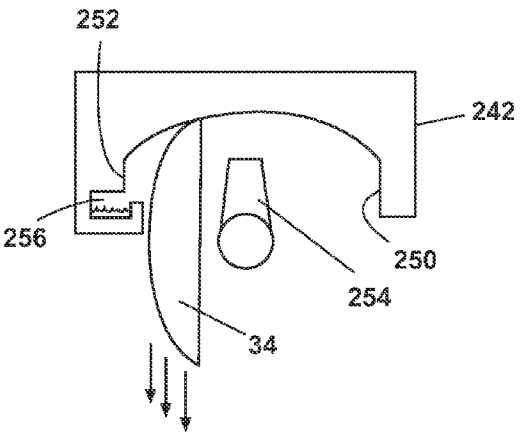
FIG. 21C is a schematic cross section view of the rotatable ice maker mold in the position illustrated in FIG. 20C.
Figure 21B:
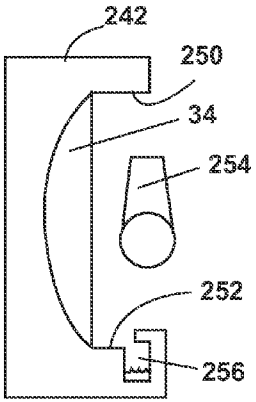
FIG. 21B is a schematic cross section view of the rotatable ice maker mold in the position illustrated in FIG. 20B.
Figure 21A:
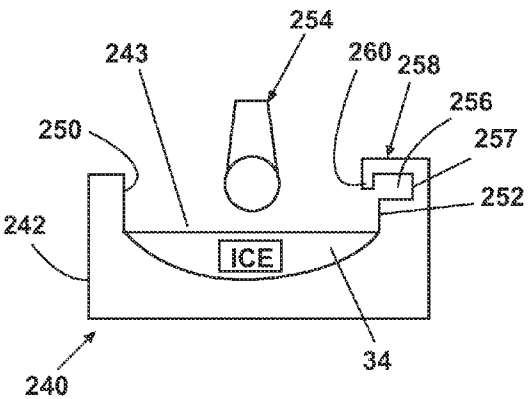
FIG. 21A is a schematic cross section view of the rotatable ice maker mold in the position illustrated in FIG. 20A.

In FIGS. 20A and 21A ice mold 242 is illustrated in the home position. In the home position ice mold is open upwardly and comprises the filling and ice forming position. A fill tube (not shown) can extend from water inlet element 123 into the refrigerator freezer cabinet and connect to a source of water. After water has frozen into ice cubes 34, a temperature sensor 245 (FIG. 27) can operate to initiate an ice harvesting cycle as is well known in the art and can be similar to the ice makers disclosed in the U.S. patents incorporated by reference in conjunction with FIGS. 3 and 4 above. During an ice harvesting cycle motor 35 can be arranged to cause ice mold 242 to rotate clockwise 180° as shown in FIGS. 20B, 20C, 21B and 21C. In FIGS. 20B and 21B ice mold 242 is shown rotated 90° with water melted by the ice mold heater (not shown) collected in channel 256. At 90° rotation ice cubes 34 have not yet contacted stationary ice rake 254. However, as ice mold 242 continues to rotate toward the 180° rotation position shown in FIGS. 20C and 21C ice rake 254 has ejected ice cubes 34 allowing the ice cubes to fall into the underlying ice cube storage bin (not shown in this embodiment). In the 180° rotation position shown in FIGS. 20C and 21C channel 256 can retain water formed when the ice mold heater 117 heats the ice mold to release ice cubes 34 from the mold 242. Motor 35 can then reverse rotation of ice mold 242 to the upright position illustrated in FIGS. 20A and 21A to begin another ice forming cycle. Any water in channel 256 can run back into ice mold cavity 243 as the ice mold 242 returns to the upright position. Ice mold 242 can include a plurality of fins 262 and can be provided with a housing to improve air flow around the ice mold as described in U.S. Pat.

No. 7,188,479 incorporated herein in its entirety as indicated above. While ice maker 240 is described in this embodiment as having a rotatable ice mold 242, those skilled in the art will understand that ice maker 240 can be arranged to be rotatable instead of having only the ice maker mold rotatable by rotatably mounting the ice maker to the refrigerator or freezer door. A rotatable ice maker could be arranged to rotate about a fixed point on the refrigerator or freezer door that can be connected to fixed ice rake 254.

Figure 22C:
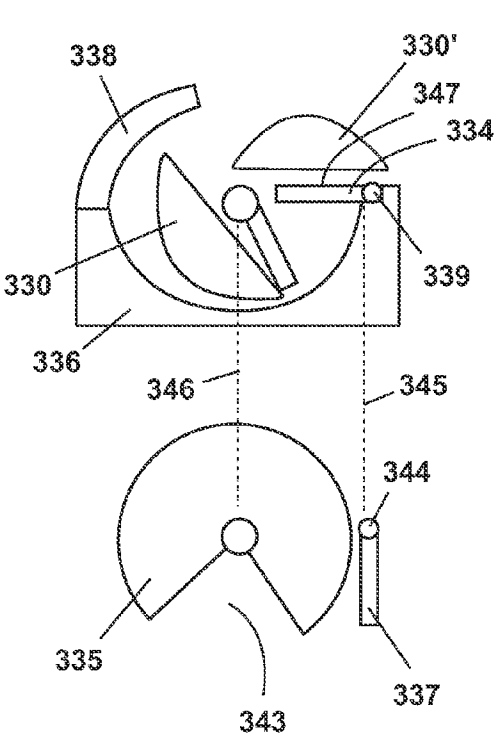
FIG. 22C is a schematic cross section view of the ice maker of FIG. 22A illustrating a subsequent point in the ice harvesting cycle.
Figure 22B:
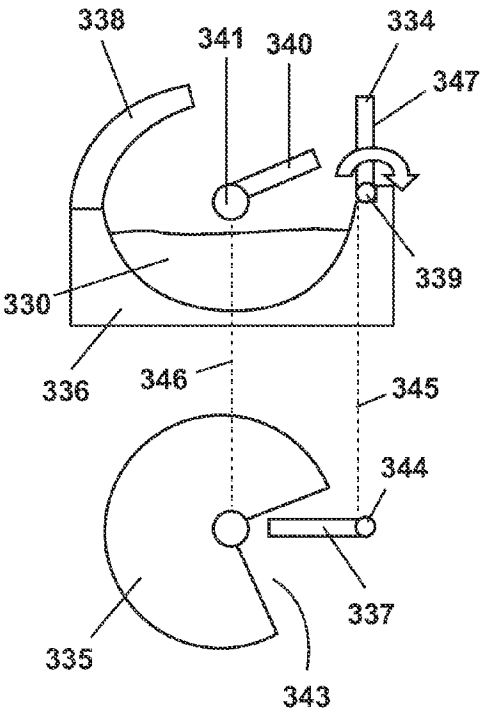
FIG. 22B is a schematic cross section view of the ice maker of FIG. 22A illustrating the beginning of an ice harvesting cycle.
Figure 22A:
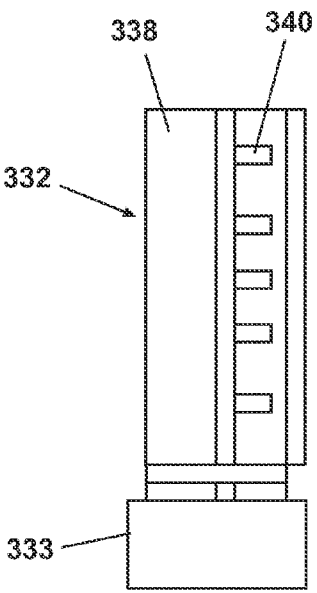
FIG. 22A is a schematic top view of another embodiment of an ice maker according to the invention.

Turning to FIGS. 22A through 22C, another embodiment of an ice maker for use on a refrigerator or freezer compartment door can be seen. In the embodiment of FIGS. 22A through 22C ice maker 332 is illustrated in schematic form and includes an ice mold 336 and ice maker control 333. The ice maker mold 336 can be an epoxy coated aluminum mold as described above. Ice maker 332 can include a rotatably mounted ice rake 340 above ice mold 336. Ice rake 340 can be rotatably mounted on rake axle 341. Ice mold 336 can include a fixed extension 338 extending upwardly and inwardly from one edge of ice mold 336. As can be seen by referring to FIGS. 22B and 22C fixed extension 338 can extend to substantially preclude splashing of water out of ice mold 336 over fixed extension 338. A hinged wall 334 can extend upwardly from the opposite side of ice mold 336. Hinged wall 334 can be epoxy coated aluminum like ice mold 336, or as will be understood by those skilled in the art can be formed of molded plastic material similar to ice strippers used in known ice makers. As can be seen by referring to FIGS. 22B and 22C hinged wall 334 can extend vertically approximately the same height as fixed extension 338. Hinged wall 334 can be pivotally mounted to ice mold 336 by a hinged wall axle 339 at the top edge of ice mold 336. Those skilled in the art will understand that hinged wall 334 can be pivotally or rotatably mounted by other mounting arrangements that can include a continuous hinge or pivots on the ends of hinged wall 334 that cooperate with pivot points connected to ice mold 336 as are well known in the art.

Ice maker control 333 can include a cam 335 that can be drivingly connected to the drive mechanism for ice rake 340, as illustrated by dashed line 346, so that as ice rake 340 is rotated during an ice cube harvest cycle cam 335 rotates. Ice maker control 333 can also include a lever 337 that can be arranged to be operated by cam 335 as it rotates with ice rake 340. Lever 337 can be pivotally mounted in ice maker control 333 at pivot 344. As shown in FIG. 22B, when hinged wall 334 is in the upright position during ice maker filling and ice cube freezing portions of an ice making cycle lever 337 can be positioned to be engaged by cam 335 as it rotates. By referring to FIGS. 22B and 22C the sequence for operation of hinged wall 334 can be seen. As ice rake 340 approaches and passes hinged wall axle 339 cutout 343 in cam 335 is opposite lever 337 allowing lever 337 to remain in the vertical position shown in FIG. 22B on pivot 344. As ice rake 340 continues to rotate into and through ice mold 336 the surface of cam 335 can engage lever 337 and pivot lever 337 down into the downwardly extending position shown in FIG. 22C. Lever 337 can be connected to hinged wall 334 as illustrated by dashed line 345 so that as lever 337 is rotated between the FIGS. 22B and 22C positions hinged wall 334 pivots from the vertical position (FIG. 22B) to the horizontal position (22C). At the end of an ice cube harvesting cycle ice rake 340 can return to a position extending generally upward and cam 335 cutout 343 positioned opposite lever 337 so that hinged wall 334 can resume the vertical position illustrated in FIG. 22B. The outer surface 347 of hinged wall (in FIG. 22B) can be flat or can have ridges or ribs extending generally perpendicular to ice rake 340 to facilitate ice cubes 330 sliding off hinged wall 334 as ice rake 340 completes its rotation through ice mold 336. An ice cube 330' is shown positioned over hinged wall 334 in FIG. 22C to illustrate the operation of hinged wall 334 as a stripper. At the stage of an ice harvest cycle illustrated in FIG. 22C ice cube 330 is still be ice mold 336 as shown. In this sense hinged wall 334 can function similar to the ice stripper described in U.S. Pat. Nos. 4,649,717 and 4,649,718 incorporated above by reference. Hinged wall 334 can be biased to the upright position (FIG. 22B) by a torsion spring (not shown) so that lever 337 can move hinged wall 334 to the horizontal position by compressing the torsion spring. When cam 335 returns to a position where cutout 343 is opposite lever 337 the torsion spring can return hinged wall 334 to the vertical position. Alternately hinged wall 334 can be mechanically driven by lever 337 to pivot hinged wall 334 between the vertical and horizontal positions is will be readily understood by those skilled in the art. Thus, in operation, hinged wall 334 and fixed extension 338 can extend vertically above ice mold 336 to contain splashing of water out of ice mold 336 during the filling and ice cube freezing portions of an ice making cycle. At the beginning of an ice harvesting cycle hinged wall 334 can be pivoted to the position shown in FIG. 22C to allow ice cubes 330 to be pushed over hinged wall 334 into an underlying ice cube storage bin (not shown). As mentioned above, the outside surface 347 of hinged wall 334 can have ridges or ribs running generally perpendicular to ice rake 340 to facilitate ice cubes sliding off hinged wall 337 as it functions as an ice stripper in a conventional ice maker as described in the referenced U.S. patents identified above. An advantage of the hinged wall configuration of FIGS. 22A through 22C is that a conventional ice stripper structure extending over ice mold 336 can be eliminated. Eliminating the ice stripper removes the possibility of water splashing out of the ice mold onto the ice stripper during the filling and ice cube freezing cycle. Ice on an ice stripper could prevent ice rake 340 from rotating through ice mold 336 during the harvest cycle to push ice cubes 330 out of the ice mold 336.

Figure 23:
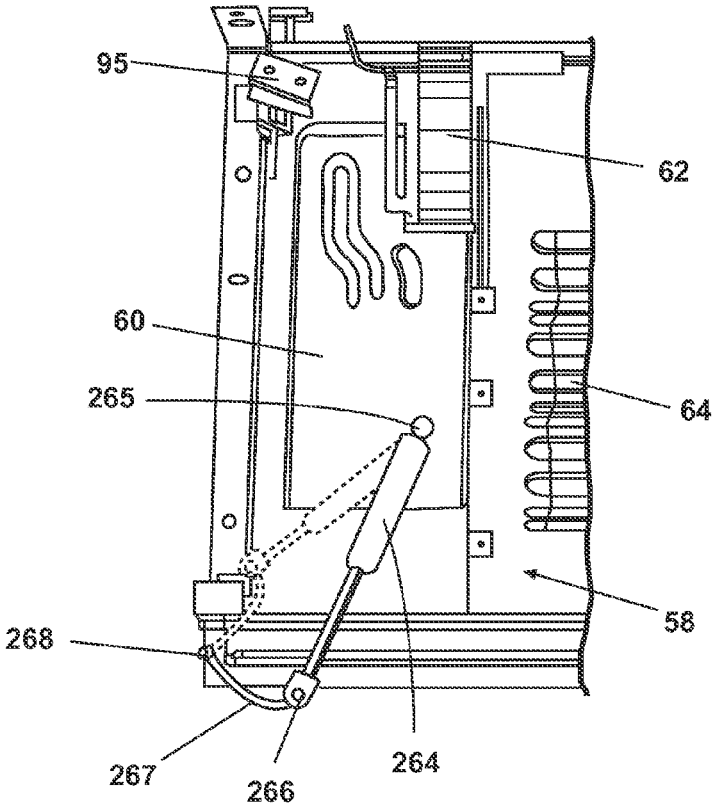
FIG. 23 is a partial perspective view of the machinery compartment for a refrigerator freezer having an ice maker positioned on the freezer compartment door of a side by side refrigerator freezer illustrating one embodiment of a door damper for use with ice makers according to the invention.
Figure 24A:
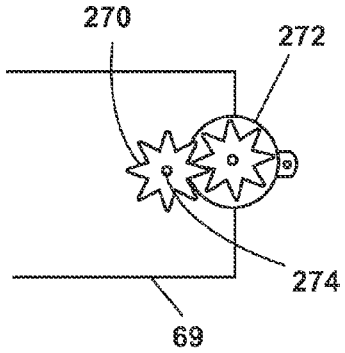
FIG. 24A is a partial schematic view illustrating another embodiment of a door damper for use with ice makers according to the invention.
Figure 24B:
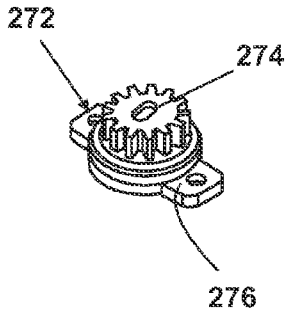
FIG. 24B is a partial perspective view of the damper of FIG. 24A.

Turning to FIGS. 23, 24A and 24B door dampers for use in conjunction with a refrigerator or freezer compartment door having an ice maker mounted thereon can be seen. It should be understood that a door damper as described in connection with FIGS. 23, 24A and 24B can be used in combination with any of the ice maker embodiments described above. In FIG. 23 one embodiment of a door damper can be seen positioned at the bottom of refrigerator freezer cabinet 52 in the machinery compartment 58. Those skilled in the art will understand that a drain pan 60 can be located in the bottom of machinery compartment 58 to provide a location for defrost water to drain for evaporation. Drain pan 60 can also provide a location for spilled water from an ice maker combined with a tray such as illustrated in FIGS. 3 and 4. A suitable drain line (not shown) can connect drain 130 on tray 128 to drain pan 60 for disposing of water spilled from an ice maker on a refrigerator or freezer compartment door. Those skilled in the art will understand that the refrigeration system compressor (not shown), condenser 64 and condenser fan 62 typically located in machinery compartment 58 can provide heat and air flow for evaporating water drained into drain pan 60. In FIG. 23 a damper 264 can be pivotally mounted to a bracket in the machinery compartment at pivot 265. The opposite end of damper 264 can be pivotally connected to bracket 267 that can be fixed to a door (not shown) or door hinge (not shown) at 268. Damper 264 can be a gas spring that dampens in both directions. Those skilled in the art will understand that damper 264 can be a hydraulic or spring loaded damper instead of a gas spring damper. Bracket 267 and damper 264 can be arranged so that the door goes over center relative to damper 264 as the door closes so that the door motion can be damped on closing as well as on opening. The damping effect of the gas spring in damper 264 can provide damping of the door opening or closing movement to preclude, or substantially reduce, the possibility of splashing water out of an ice maker positioned on the door as described above.

Turning to FIGS. 24A and 24B a rotary damper embodiment can be seen. Rotary damper 272 can comprise a damper gear 274 rotatably mounted to damper base 276. Rotary dampers are well known in the art and can include viscous or friction material coupling damper gear 274 to damper base 276. Known devices include uni-directional or bi-directional rotary dampers. Rotary damper 272 can be mounted to a fixed element such as a hinge element (not shown) attached to the refrigerator freezer cabinet 52 (FIG. 1A). Gear 270 can be fixed to a rotating hinge element such as on the hinge pin (not shown) attached to refrigerator door 69 (FIG. 1A). Rotary damper 272 can be positioned so that damper gear 274 engages gear 270 when door 69 is positioned on cabinet 52. In operation as door 69 is opened or closed gear 270 turns damper gear 274. The damping effect of the viscous or friction material between damper gear 274 and damper base 276 can provide damping of the door opening or closing movement to preclude, or substantially reduce, the possibility of splashing water out of an ice maker positioned on the door as described above. Those skilled in the art will understand that rotary damper 272 or damper 264 can be uni-directional dampers if desired, although bi-directional damping is preferred to help assure that water spills are prevented on door closing as well as on door opening movement.

Figure 25:
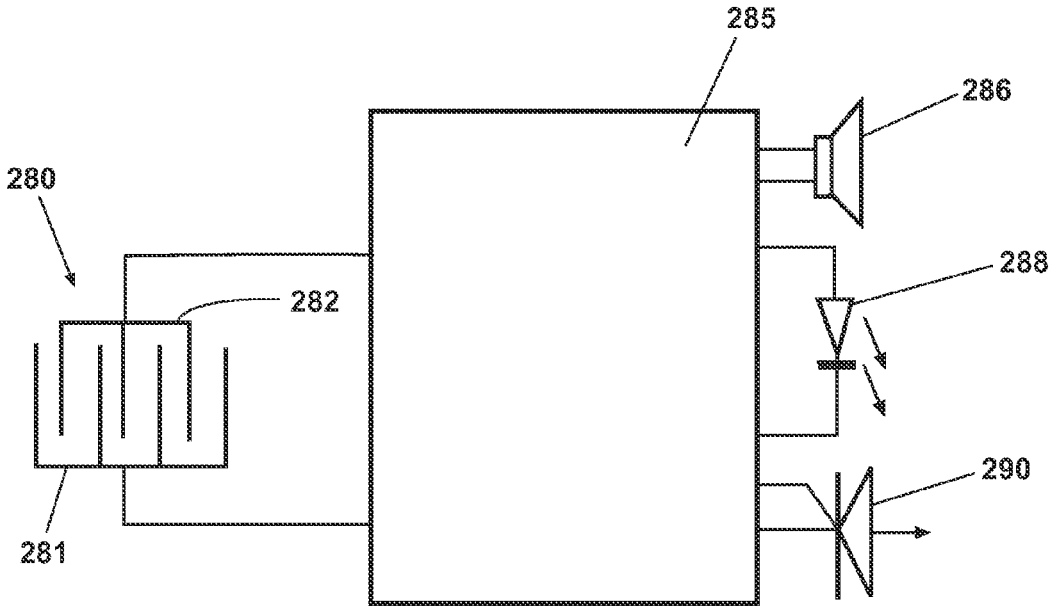
FIG. 25 is a circuit diagram illustrating spill sensor elements that can be used with ice maker embodiments according to the invention.

Turning to FIG. 25 a spill sensor and spill control according to the invention can be seen. In addition to providing a tray 128 (FIG. 3) to retain any water spilled or splashed out of one of the ice maker embodiments described above, a spill sensor 280 and spill control 285 can be provided to alert the user that a spill has occurred and/or automatically take action in response to the spill. Spill sensor 280 can be two groups of metal plates 281, 282 located in tray 128 arranged to be contacted by any water spilling out of an ice maker positioned on tray 128. When water or ice is present on metal plates 281, 282 the electrical resistance across plates 281, 282 can change and produce a signal to spill control 285 indicating water or ice is present in tray 128. Those skilled in the art will understand that plates 281, 282 can be discrete conductive plates positioned on tray 128, or, if desired, can be conductive film or ink printed on tray 128. Spill control 285 can be arranged to activate one or more of outputs that can include a audible beeper 286, an LED display 288 that can be positioned on user interface 73 (FIG. 1A) and a power output that can comprise an electronic switch (i.e. a SCR) 290 to activate an element in response to the spill detection. For example, electronic switch 290 can be arranged to activate a pump 292 for pumping water from tray 128 as described above, or can be arranged to activate heater 132 for tray 128 as described above. Thus, a spill sensor and control can alert the user that a water spill has occurred and/or can activate a remedial response to the spill. Alerting the user to a spill can allow the user to clean up the spill promptly to avoid ice build up around the base of the ice maker that can occur if water is not drained away or otherwise disposed of soon after a spill occurs.

Figure 26:
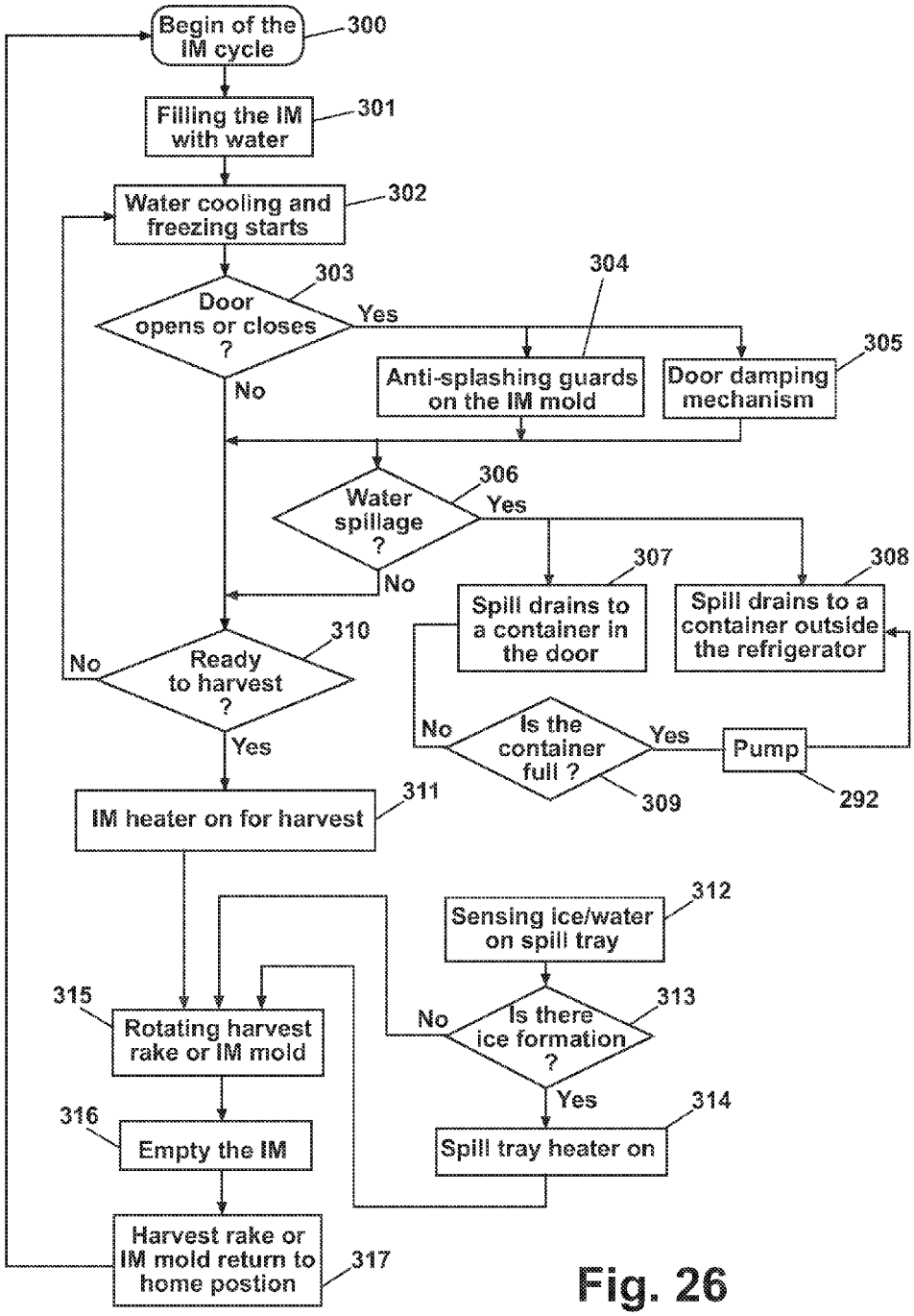
FIG. 26 is a block diagram illustrating operation of a refrigerator freezer including ice maker spill management according to the invention.
Figure 27:
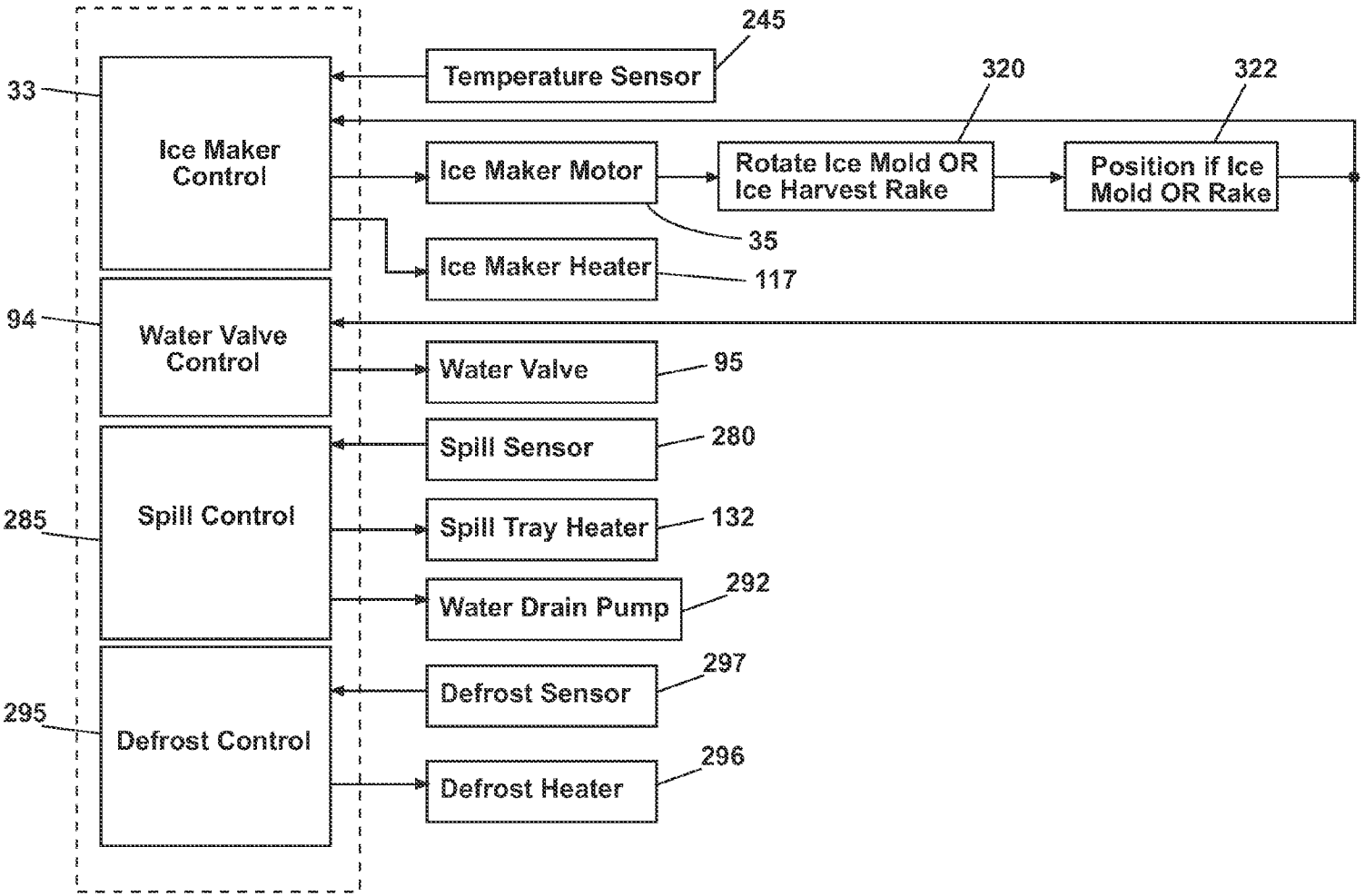
FIG. 27 is a circuit diagram illustrating electrical elements that can be used with ice maker embodiments according to the invention.

Turning to FIGS. 26 and 27, operation of applicants' spill management invention for refrigerator or freezer compartment door mounted ice makers will be described in greater detail. The operation described below will be understood to apply to all the ice maker embodiments described above unless otherwise noted. At the beginning of an ice making cycle, step 300, water valve 95 can be activated by water valve control 94 to fill the ice maker with water, step 301. The ice maker is located in a below 0° C. temperature location and accordingly the water cools and begins to freeze, step 302. If the door on which the ice maker is opened or closed while liquid is present in the ice mold, step 303 the anti-splashing features, step 304, of the above described ice maker embodiments and, if applicable, the door damping mechanism, step 305, can operate to prevent spills of water from the ice mold. If, notwithstanding the anti-splashing features, step 304, and door damping mechanism, step 305, water spills, step 306, spill management aspects of the invention can operate if provided. If a tray 128 is provided, water spilled can drain into a container in the door, step 307, if provided, or to a container outside the refrigerator such as drain pan 60, step 308. Door container can be provided with a pump 292 to empty the container when full, step 309. As noted above, pump 292 could also be arranged to pump water from tray 128 to a remote or elevated storage container or to a household drain if desired (not shown in FIG. 26). When ice maker temperature sensor 245 senses a temperature indicating that ice cubes have fully frozen an ice harvest cycle, step 310 can begin. Except for flexible tray ice makers an ice mold heater 117 can be activated to free ice cubes from the ice mold, step 311. During ice harvest when the ice maker is provided with a spill sensor 280 and spill control 285, spill control 285 can determine if ice or water is present in tray 128, step 312. If ice is present in the tray 128, tray heater 132 can be activated to melt ice in the tray during ice harvest, step 314. When ice mold heater has been activated long enough the ice maker motor can be activated to rotate the ice rake or ice mold depending on the ice maker embodiment using control techniques known in the art, step 315. Alternately, spill control 285 can be arranged to activate a user indicator, beeper 286 or LED 288, in the event of a water spill as described above to signal the user to attend to the spill as described above. Those skilled in the art that spill control can also be arranged to activate tray heater 132 each time defrost control 295 initiates a defrost cycle for the refrigerator freezer. For example, tray heater 132 can be connected to be energized when defrost heater 296 is activated. Those skilled in the art will understand that a defrost cycle can be initiated periodically, or can be initiated by a defrost sensor 297. In the case of flexible tray ice makers or rotating mold ice makers steps 311 through 314 can be skipped. Ice maker control 33 can cause ice maker motor 35 to rotate the ice rake or ice mold, block 320, for flexible tray or rotating mold ice makers. Ice maker control 33 can also determine the position of the ice mold or ice rake, block 322, in order to enable the water valve control 94 to initiate a new fill and ice cube freezing cycle if more ice is called for by the bin level sensing control. After the ice mold or ice rake has rotated and the ice mold is empty, step 316, the ice rake or ice mold can return to the home position, step 317. Following step 317 the ice maker can begin another ice maker cycle if the ice cube storage bin level sensing control calls for more ice.

The inventive concepts described herein provide the convenience of ice and water dispensing located entirely on a refrigerator or freezer compartment door. In the case of side by side refrigerator freezers locating the ice maker, ice cube storage bin and dispenser on the freezer compartment door can provide an additional freezer compartment shelf storage area. In the case of bottom freezer refrigerators locating the ice maker, ice cube storage bin and dispenser on a refrigerator compartment door as disclosed in U.S. Pat. No. 7,188,479, incorporated herein by reference as indicated above can simplify provision of an ice and water dispenser for a bottom freezer refrigerator configuration. The spill management inventions described herein make practical locating an ice maker on a refrigerator or freezer compartment door.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention, which is defined in the appended claims.

We claim:

1. A refrigerator freezer comprising:

a freezer compartment maintained at a temperature below 0° C. having a top wall and having an insulated freezer compartment door having an inner door;

a refrigerator compartment maintained at a temperature above 0° C. and having an insulated refrigerator compartment door;

a refrigeration system for cooling the freezer compartment and the refrigerator compartment;

an automatic ice maker positioned on the inner door of the freezer compartment door;

an ice storage bin positioned below the ice maker;

a cover pivotally mounted adjacent the top of the ice maker and arranged to enclose the ice maker in a first position and to form an ice chute from the ice maker to the ice storage bin in a second position.

2. The refrigerator freezer according to claim 1, wherein the cover is pivotally mounted adjacent the top of the ice maker adjacent the side of the ice maker opposite the inner door.

3. The refrigerator freezer according to claim 2, wherein cover includes an actuator connected to the cover and arranged to pivot the cover about a hinge point.

4. The refrigerator freezer according to claim 3, wherein the actuator is arranged to engage the top wall of the freezer compartment when the freezer compartment door is closed.

5. The refrigerator freezer according to claim 4, wherein the cover includes a spring mechanism to bias the cover toward the first position.

6. The refrigerator freezer according to claim 5, wherein the cover is in the first position when the freezer compartment door is open and the actuator moves the cover to the second position when the freezer compartment door is closed.

7. The refrigerator freezer according to claim 1, wherein the ice storage bin is arranged to be removable from the freezer compartment door when the cover is in the first position.

8. The refrigerator freezer according to claim 1, wherein the cover includes a motor for pivoting the cover about a hinge to the second position when the freezer compartment door is closed.

9. The refrigerator freezer according to claim 1, wherein the cover includes a motor for pivoting the cover about a hinge to the second position when the ice maker harvests ice cubes.

10. The refrigerator freezer according to claim 1, further including a door damper connected to the freezer compartment door.

11. A method of making ice in a refrigerator freezer in which an automatic ice maker having an ice mold and a movable cover substantially covering the ice mold and an ice cube storage bin mounted below the automatic ice maker are mounted on the one of the refrigerator and freezer compartment doors comprising:

operating the refrigerator freezer to provide cooling to the refrigerator and freezer compartments;

filling the ice mold with water;

preventing spills of water from the ice maker when the refrigerator or freezer compartment door on which the ice maker is mounted is opened or closed; and harvesting ice pieces from the ice mold after the water has frozen, wherein the step of harvesting ice cubes further comprises opening the cover forming a chute for ice cubes into the ice cube storage bin.

12. A method of making ice in a refrigerator freezer in which an automatic ice maker having an ice mold and a movable cover substantially covering the ice mold and an ice cube storage bin mounted below the automatic ice maker are mounted on the one of the refrigerator and freezer compartment doors comprising:

operating the refrigerator freezer to provide cooling to the refrigerator and freezer compartments;

filling the ice mold with water;

preventing spills of water from the ice maker when the refrigerator or freezer compartment door on which the ice maker is mounted is opened or closed; and harvesting ice pieces from the ice mold after the water has frozen, wherein the movable cover further comprises an actuator arranged to open the cover, wherein the step of harvesting ice cubes further comprises operating the actuator when the one of the refrigerator and freezer compartment doors is closed.

* * * * *